US010959506B2

(12) United States Patent
Heston

(10) Patent No.: US 10,959,506 B2
(45) Date of Patent: Mar. 30, 2021

(54) 3D KNIT STRUCTURED BAG

(71) Applicant: Seamless Accessories LLC, Malvern, PA (US)

(72) Inventor: Colin Heston, Malvern, PA (US)

(73) Assignee: SEAMLESS ACCESSORIES LLC, Malvern, PA (US)

( * ) Notice: Subject to any disclaimer, the term of this patent is extended or adjusted under 35 U.S.C. 154(b) by 0 days.

(21) Appl. No.: 16/701,767

(22) Filed: Dec. 3, 2019

(65) Prior Publication Data

US 2020/0170387 A1 Jun. 4, 2020

Related U.S. Application Data

(60) Provisional application No. 62/774,973, filed on Dec. 4, 2018.

(51) Int. Cl.

| | |
|---|---|
| ***A45F 3/04*** | (2006.01) |
| ***A45C 3/00*** | (2006.01) |
| ***A45C 13/02*** | (2006.01) |
| ***D04B 1/22*** | (2006.01) |

(Continued)

(52) U.S. Cl.

CPC ..... *A45F 3/04* (2013.01); *A45C 3/001* (2013.01); *A45C 13/02* (2013.01); *D04B 1/22* (2013.01); *D04B 21/20* (2013.01); *A45C 2011/003* (2013.01); *A45C 2013/025* (2013.01); *D10B 2331/02* (2013.01); *D10B 2403/0331* (2013.01)

(58) Field of Classification Search

CPC ..... A45F 3/04; A45F 3/08; A45F 3/10; A45C 3/001; A45C 13/02; D04B 1/22; D04B 21/20

See application file for complete search history.

(56) References Cited

U.S. PATENT DOCUMENTS 5,603,573 A 2/1997 Mercier et al.
8,381,956 B2 * 2/2013 Gleason, Jr. ..... A45F 3/10 224/645

(Continued)

FOREIGN PATENT DOCUMENTS

WO 2005051119 A2 6/2005

OTHER PUBLICATIONS

International Search Report issued by the International Searching Authority for corresponding International Patent Application No. PCT/US 2019/064381, dated Apr. 16, 2020.

*Primary Examiner* — Derek J Battisti
(74) *Attorney, Agent, or Firm* — Myers Wolin, LLC

(57) ABSTRACT

A bag assembly has a primary storage chamber and a carrying structure, and the carrying structure having a panel and a shoulder strap extending from the panel. The strap and the panel are seamlessly integrated. The primary storage chamber is a first three dimensional (3D) knit structure having a first material or combination of materials and the carrying structure is a second 3D knit structure having a second material or combination of materials. The primary storage chamber is fixed to the panel of the carrying structure to form the bag assembly. Also provided is a bag assembly in which the primary storage chamber is a first 3D knit structure having a first knit pattern and the carrying structure is a second 3D knit structure having a second knit pattern. Also provided is a method for customizing locations of 3D knit features based on user dimensions.

19 Claims, 32 Drawing Sheets

(51) Int. Cl.
*D04B 21/20* (2006.01)
*A45C 11/00* (2006.01)

(56) References Cited

U.S. PATENT DOCUMENTS

| | | | | |
|---|---|---|---|---|
| 8,789,734 | B2 * | 7/2014 | Cross | A45C 13/26 224/628 |
| 9,119,460 | B2 * | 9/2015 | Ables | A45F 3/047 |
| 9,687,063 | B2 * | 6/2017 | Paduano | A45F 3/08 |
| 10,098,431 | B2 * | 10/2018 | Davis | A45C 5/14 |
| 10,694,834 | B2 * | 6/2020 | Logan | A45C 5/141 |
| 2009/0127299 | A1 * | 5/2009 | Jamlang | A45F 3/14 224/153 |
| 2011/0084101 | A1 | 4/2011 | Guillon et al. | |
| 2017/0022640 | A1 * | 1/2017 | Schenk | D04B 21/20 |
| 2017/0099920 | A1 | 4/2017 | Bailey | |
| 2018/0255909 | A1 * | 9/2018 | Piche-Rouillard | A45F 3/04 |

* cited by examiner

3D KNIT STRUCTURED BAG

CROSS REFERENCE TO RELATED APPLICATIONS

This application takes priority from U.S. Provisional Application No. 62/774,973, filed Dec. 4, 2018, the entire contents of which are hereby incorporated herein.

FIELD OF THE INVENTION

The present invention relates generally to structured bags and personal storage devices constructed using three dimensional knitting techniques, also known as flat-bed knitting. More specifically, the invention relates to backpacks, messenger bags, purses, and duffle bags comprising 3D knitted components.

BACKGROUND

A wide variety of material elements are conventionally utilized in the manufacturing of a bag, such as a backpack and its multiple components. It will be understood that while this disclosure specifically discusses backpacks, the disclosure also relates to other structured bags, such as messenger bags, purses, and the like. Parts of a traditional backpack are constructed from multiple layers that include a variety of joined material elements. Different material elements are selected to impart a variety of properties such as stretch-resistance, wear-resistance, flexibility, cushioning, moisture-wicking, and breathability.

In order to impart different desired properties to different areas of the backpack, material elements are typically cut into a variety of shapes from sheets of material and joined together, usually with stitching, adhesive bonding, or heat welding. Furthermore, material elements are typically joined in a layered configuration to impart multiple properties to desired areas. As the number and variety of material elements incorporated into the backpack increases, the time, labor, and expenses associated with the stocking, cutting, and joining of material elements also increases. Waste material from the cutting and stitching processes also accumulates to a greater degree as the number and variety of material elements incorporated into the backpack increases. Waste materials are generally unusable as well as difficult and expensive to dispose of after production. The cut & sew process for soft goods, accessories, and bags has seen very little change or innovation in many years, and remains extremely labor intensive, wasteful, and expensive.

Accordingly, typical backpack construction is extremely labor intensive and done manually through the process of cutting a variety of shapes from numerous different material elements, and bonding/layering them together through sewing, gluing, heat welding, etc. in order to create a three dimensional shape. As the number and type of material elements incorporated into a backpack increase, the time and expense associated with transporting, stocking, cutting, and joining the material elements also increases. Waste material from cutting and stitching processes also accumulates to a greater degree. Moreover, backpacks with a greater number of material elements may be more difficult to recycle than backpacks formed from fewer types and numbers of material elements. Current cut & sew techniques used within the backpack manufacturing industry are labor intensive, expensive, require complex assembly line processes, are extremely wasteful in both material use and production processes, and have variable quality product due to human error.

SUMMARY

Three-dimensional, or 3D, knitting, also known as flat-bed knitting, is a form of additive manufacturing, whereas products are built up layer-by-layer and stitch-by-stitch from a single strand of yarn and combined into one fully-formed textile. The textile (in this case a backpack or other structured bag) is produced on "needle-beds" where every individual stitch and needle is controlled and manipulated autonomously through the use of computer aided design software and user programming.

Utilizing 3D knitting technology allows for the ability to engineer a backpack using computer aided design software that allows the programming of individual stitches into one single three-dimensional textile. The textile/backpack is built up from individual strands of yarn and combined in a variety of orientations and locations to instill desired features into one seamless piece, revolutionizing the way soft goods and accessories are manufactured. The seamless textile/backpack creates little to no waste during the production process and uses primarily autonomous manufacturing techniques, which minimizes the amount of secondary labor processes involved. Having the ability to combine multiple materials from single strands of yarn into a seamlessly engineered textile, the need for layering and joining material elements to form single pieces is dramatically reduced or eliminated. Combining various yarn elements into specifically engineered formations, areas, and structures gives the ability to impart different desired properties and features to specific areas. These properties and features include but are not limited to stretch-resistance, wear-resistance, flexibility, cushioning, moisture-wicking, and breathability, as well as three-dimensional structures, pockets, openings, gear loops, and webbing, all incorporated into one seamlessly engineered textile. With the ability to produce a single three-dimensional piece from individual strands of yarn, the need for cutting and joining material through stitching, adhering, and bonding is dramatically reduced or eliminated. By eliminating the need for cutting, layering, and joining different elements, the production of unusable waste material is dramatically decreased or eliminated. This allows for the ability to create a unique one-piece textile/backpack through the careful engineering and programming of individual stitches and yarn combinations that come together to produce a sustainable, seamless, strong, and cost effective product.

A structure manufactured by way of 3D knitting may therefore have fewer or no seems and may be produced autonomously and with little waste. Such manufacturing reduces the amount of human labor dramatically, and similarly reduces the opportunities for human error. The structured bags produced may be more durable, as fewer seems would provide fewer potential fail points, and would require less material. Further, since textiles can be directly produced in their final, or near final form, cutting out time consuming and labor intensive processes, less time and labor are involved in such manufacturing.

Accordingly, using three-dimensional knitting for backpack construction may reduce the number of backpack components and construction methods from hundreds to a handful. By decreasing the number of material elements utilized in a backpack, waste is decreased while increasing the manufacturing efficiency and recyclability of the backpack.

By autonomously engineering all the desired attributes into one seamless three-dimensional piece, the act of flatbed knitting dramatically reduces labor hours, construction steps, and production variation due to manual intervention. This reduction in labor and construction methods subsequently allows for the opportunity to manufacture domestically without taking advantage of a foreign adverse workforce. Typically, it would be difficult, if not impossible, to compete with the price points of foreign manufacturing. The methods and structures described herein allow for substantial automation, thereby allowing domestic labor to become cost competitive.

Beneficial features of a three-dimensionally knit backpack components over a traditional cut & sew backpack may include the following:

a. Lightweight (elimination of secondary materials, bonding materials, and the layering of materials).
b. Seamless/Fully-Fashioned (less fail points, less bulk, longer lasting, and increased durability).
c. Less Labor (consolidation of what would be multiple processes into one; as well as autonomous construction and assembly; seamless integration of multiple features and attributes).
d. Less Waste (consolidation of what would be multiple processes and materials; elimination of cutting and sewing therefor elimination of cut-off waste materials and production waste materials).
e. Consistent Quality (less human error).
f. Increased Manufacturing Efficiency (less production processes).
g. Enhanced Ergonomics & Usability.
h. Seamless Integration of Features.
i. Seamless Integration of Material Attributes (engineering of specialty stitch structures and yarn combination for desired attributes; moisture wicking, breathability, air-flow, four way stretch, two way stretch, padding, etc.).

Further, individual knit components can be custom made and shaped for individual users proportions for an optimal and ergonomic fit. Users may input data and measurements so that components can be tailored to their proportions. This can be done multiple ways such as 3D scanning, inputting measurements into a web based program, pictures of users body and measurements, etc.

Similarly, feature layouts can be custom tailored inside and outside the bags to the individual users' needs, depending on user data inputs about what they carry on a day to day basis. This can be done through user data input on a web based program, 3D scans, pictures of user's devices, etc.

Accordingly, a bag assembly is provided comprising a primary storage chamber and a carrying structure comprising a panel and at least one shoulder strap extending from the panel. The strap and the panel are seamlessly integrated. The primary storage chamber is a first three dimensional (3D) knit structure comprising a first material or combination of materials and the carrying structure is a second 3D knit structure comprising a second material or combination of materials different than the first. The primary storage chamber is fixed to the panel of the carrying structure to form the bag assembly.

In some embodiments, the primary storage chamber is open on one side, and a rim of the primary storage chamber is fixed to a boundary of the panel of the carrying structure, such that the panel encloses an interior of the primary storage chamber.

In some embodiments, the primary storage chamber comprises a fusible yarn and the carrying structure does not. For example, the primary storage chamber may comprise a primary yarn and secondary yarn, with the secondary yarn being the fusible yarn. The primary yarn may be nylon and the secondary yarn may be a low melt polymer. In such an embodiment, the primary storage chamber is first assembled by a 3D knitting process and is then heated over a mold to melt the low melt polymer, thereby stiffening the primary storage chamber. Alternatively, the fusible yarn may comprise a nylon sheath spun around a low melt core. In such an embodiment, the primary storage chamber may comprise only a single yarn.

The carrying structure may also comprise a primary yarn and a secondary yarn, and for the carrying structure, the primary yarn may be an elastic polyester and the secondary yarn may be a monofilament. Alternatively, the primary yarn may be nylon and the secondary yarn of the carrying structure may be an elastic yarn.

Generally, in embodiments where the primary storage chamber comprises a fusible yarn, the chamber may further comprise integrated linear segments that don't include fusible yarn. The linear segments may define openings in a storage chamber, and the fusible yarn may therefore be selectively integrated using I-Kat plating techniques. In some embodiments, the linear segments may define a folding location or pattern, wherein after the fusible yarn is fussed, the primary storage chamber is foldable along the linear segments.

In some embodiments, the panel has a first end and a second end, and the at least one strap extends from the first end, and the panel further comprises at least one wing extending from or adjacent the second end, and the wing comprises a thick nylon knit structure and the shoulder strap comprises a spacer mesh structure. The bag assembly may then further comprise a linking strap fixed to the shoulder strap at a first end and to the wing at the second end. The linking strap may be fixed to the shoulder strap at a knit slot in the corresponding shoulder strap, where the knit slot may be reinforced.

In some embodiments, the panel further comprises a dense and stiffened spacer knit forming an outer boundary around the panel. The at least one shoulder strap is then seamlessly fixed to the outer boundary, and at least a portion of the panel within the outer boundary and at least a portion of the at least one shoulder strap comprises a spacer knit less dense and less stiff than the outer boundary.

The panel may further comprise a dense and stiffened inner boundary, with the inner boundary encompassing an inner segment of the panel, and the outer boundary and the inner boundary may then combine to define a channel therebetween. The channel then comprises a spacer knit less dense and less stiff than the outer boundary, and the inner segment of the panel comprises a porous knit structure.

In some embodiments, such as in methods discussed in more detail below, the inner boundary is located in the panel at a position based on a measured body size of an end user, such that the bag can be customized for a particular user.

Typically, the primary storage chamber is provided with surface curvature using a goreing technique. Further, the primary storage chamber may be provided with integrated loops for fixation of accessories to an outside surface of the primary storage chamber. Such integrated loops may be implemented and supported by a dedicated field generated with an intarsia technique.

In some embodiments, the bag assembly may further comprise a secondary storage chamber, the secondary storage chamber formed of a 3D spacer knit, and the secondary storage chamber may then be fixed to the carrying structure, and the primary storage chamber may then be fixed to the secondary storage chamber opposite the carrying structure.

In such an embodiment, the secondary storage chamber may be fixed to the panel of the carrying structure and the primary storage chamber by way of both sewing and zipper connection points.

In some embodiments, the bag assembly comprises a primary storage chamber, and a carrying structure comprising a panel and at least one shoulder strap extending from the panel, wherein the strap and the panel are seamlessly integrated. The primary storage chamber is a first 3D knit structure comprising a first 3D knit pattern, and the carrying structure is a second 3D knit structure comprising a second 3D knit pattern different than the first, and the primary storage chamber is fixed to the panel of the carrying structure.

In such embodiments, the panel may further comprise a dense and stiffened spacer knit forming an outer boundary around the panel. The at least one shoulder strap is then seamlessly fixed to the outer boundary, and at least a portion of the panel within the outer boundary and at least a portion of the at least one shoulder strap comprises a spacer knit less dense and less stiff than the outer boundary.

The panel may further comprise a dense and stiffened inner boundary, with the inner boundary encompassing an inner segment of the panel, and the outer boundary and the inner boundary may then combine to define a channel therebetween. The channel then comprises a spacer knit less dense and less stiff than the outer boundary, and the inner segment of the panel comprises a porous knit structure.

In some embodiments, such as in methods discussed in more detail below, the inner boundary is located in the panel at a position based on a measured body size of an end user, such that the bag can be customized for a particular user.

In some embodiments, the at least one shoulder strap comprises two shoulder straps and a connecting element in between, where the connecting element comprises a 3D spacer knit less dense than the adjacent portions of the shoulder straps. The connecting element may be more air permeable than the adjacent portions of the shoulder straps.

In some embodiments, the shoulder strap may comprise a low stretch knit segment and a high stretch knit segment, and a gradual transition from the high stretch segment to the low stretch segment. Further, the shoulder strap may comprise a support segment comprising a thicker padding knit than other segments of the shoulder strap.

Also provided is a method for manufacturing a bag assembly, the method comprising receiving end user data comprising physical characteristics of an end user of the bag assembly, identifying in the end user data a customizing dimension, positioning, in a structure layout, a customizable element at a location defined based at least partially on the customizing dimension, and generating a 3D knit structure based on the structure layout with the customizable element at the location defined. The 3D knit structure may be a carrying structure for a bag assembly, the carrying structure comprising a panel and at least one shoulder strap extending from the panel.

As discussed above, the panel may further comprise a dense and stiffened spacer knit forming an outer boundary around the panel. The at least one shoulder strap is then seamlessly fixed to the outer boundary, and at least a portion of the panel within the outer boundary and at least a portion of the at least one shoulder strap comprises a spacer knit less dense and less stiff than the outer boundary.

The panel may further comprise a dense and stiffened inner boundary, with the inner boundary encompassing an inner segment of the panel, and the outer boundary and the inner boundary may then combine to define a channel therebetween. The channel then comprises a spacer knit less dense and less stiff than the outer boundary, and the inner segment of the panel comprises a porous knit structure. In some embodiments, the inner boundary or the inner segment of the panel may be the customizable element, such that the location of those elements may be based at least partially on the customizing dimension.

Further, in some embodiments, the shoulder straps may comprise a support segment for resting on a user's shoulder, and the customizable element is the location of the support segment in the shoulder strap.

DETAILED DESCRIPTION OF THE PREFERRED EMBODIMENTS

Figure 1:
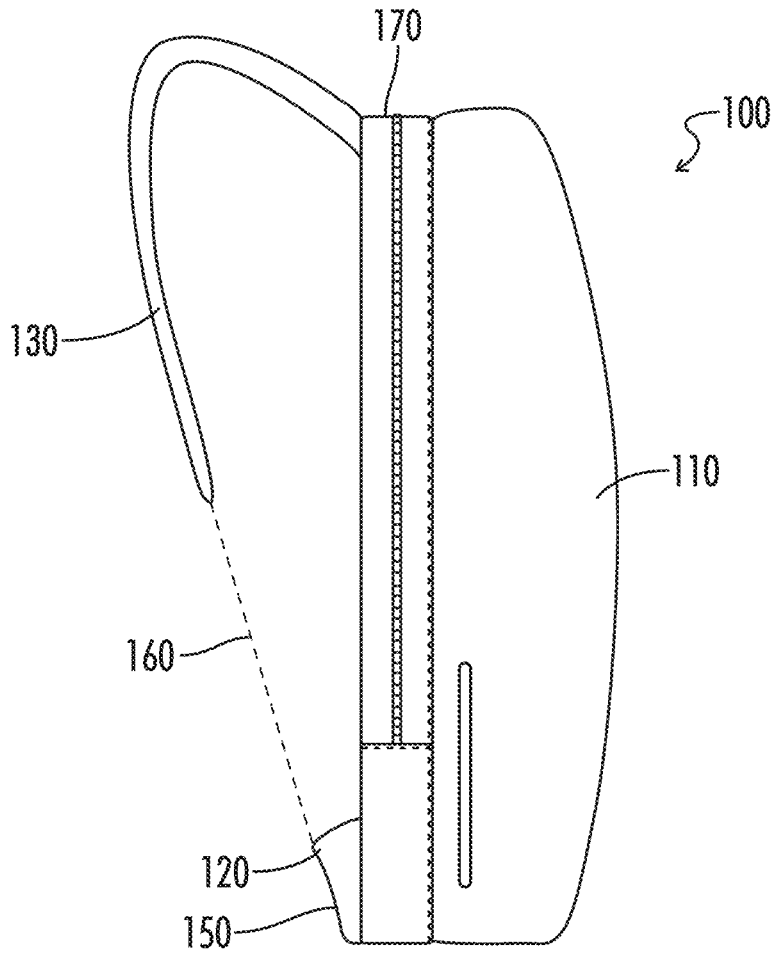
FIG. 1 is a side view of a bag assembly in accordance with this disclosure.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

This disclosure describes the best mode or modes of practicing the invention as presently contemplated. This description is not intended to be understood in a limiting sense, but provides an example of the invention presented solely for illustrative purposes by reference to the accompanying drawings to advise one of ordinary skill in the art of the advantages and construction of the invention. In the various views of the drawings, like reference characters designate like or similar parts.

Figure 2:
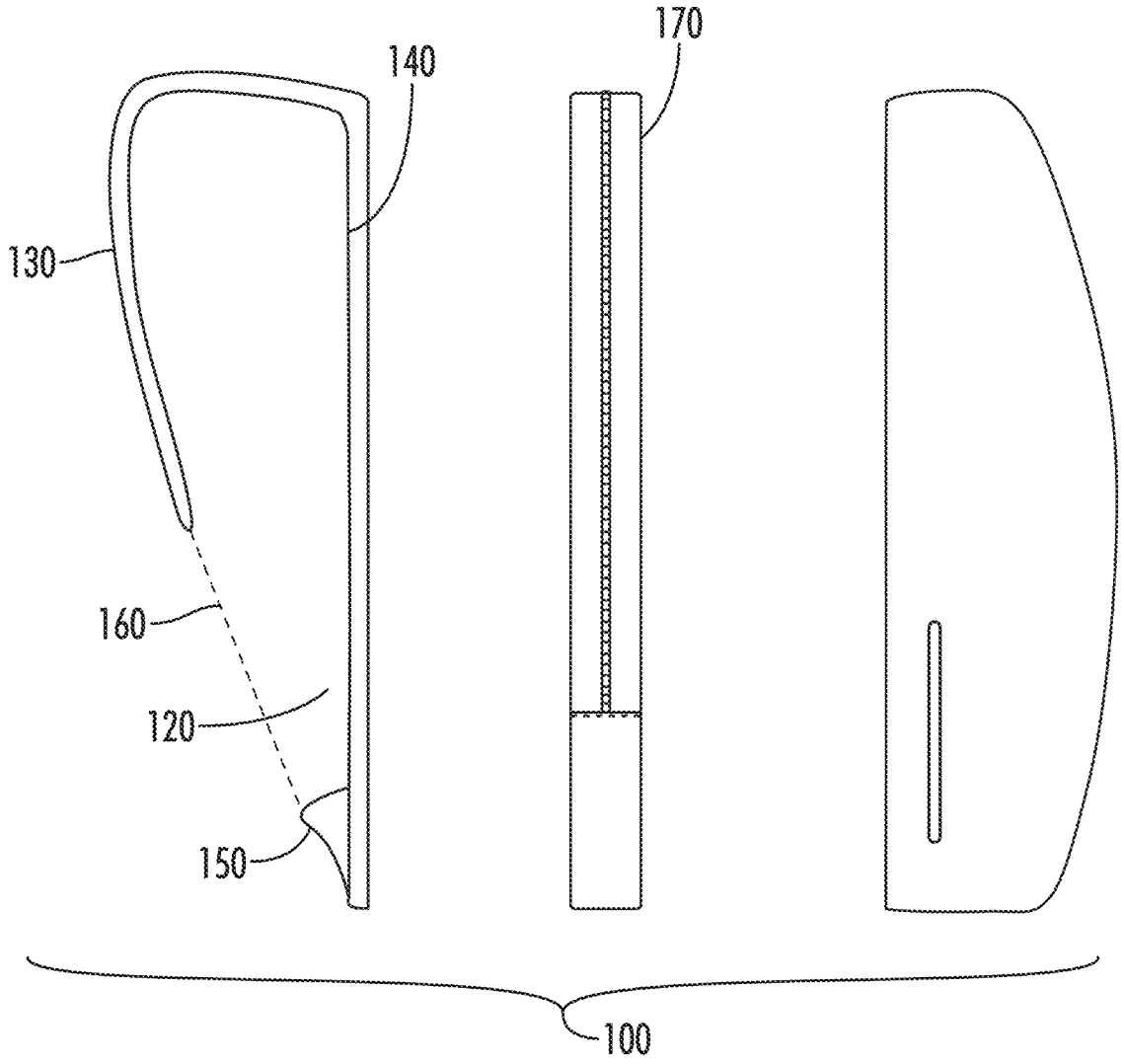
FIG. 2 is the bag assembly of FIG. 1 shown in an exploded side view.

FIG. 1 is a side view of a bag assembly 100 in accordance with this disclosure, and FIG. 2 is the bag assembly 100 shown in an exploded side view. As shown the bag assembly 100 comprises a primary storage chamber 110 and a carrying structure 120. As discussed in more detail below, the carrying structure 120 has at least one strap 130, and typically two straps in the case of a backpack, and a panel 140, with the straps being seamlessly integrated into the panel. In some embodiments, the carrying structure 120 comprises straps 130 and an independent panel 140 that may be assembled at final construction. As shown, the carrying structure 120 may further comprise wings 150 comprising a thick knit structure and a linking strap 160 linking the wing to the corresponding strap 130. While the bag assembly 100 is shown as a backpack, it will be understood that this disclosure similarly applies to a wide variety of structured bags, including purses, messenger bags, duffel bags, personal storage carrying devices, and others.

As discussed in more detail below, the primary storage chamber 110 typically has seamlessly integrated knit features, including, for example, secondary pockets, tertiary pockets, handles, webbing, sleeves, and gear loops as well as seamlessly integrated openings/slots designed to secure/add outside features such as webbing, patches, tags, buckles, hardware, and other appliques without the need for cutting and layering. Similarly, the panel 140 may have seamlessly integrated elastic and static structures for a more ergonomic fit, cushioning zones to create air channels and padding, and with air-permeable mesh sections integrated throughout for enhanced breathability.

Each of the primary storage chamber 110 and the carrying structure 120 are separate three dimensional (3D) knit structures, and the primary storage chamber 110 is made of a first material or combination of materials and the carrying structure 120 is made of a second material or combination of materials. In some embodiments, additional knit components, such as pockets and organization sleeves for interior compartments may be knitted as single components as well.

Typically, the primary storage chamber 110 is made from a different material or combination of materials than the carrying structure 120. This allows the two components to have different ranges of material properties, thereby satisfying the wide variety of requirements. Traditional backpacks rely on distinct materials for each material property needed, and those materials may need to be joined in a distinct progression and fashion, while different knit structures can generate a wide variety of finished material structures using fewer materials. For example, the 3D knit primary storage chamber 110 of the bag may comprise a primary yarn and a secondary yarn, with the secondary yarn being a fusible yarn. The primary yarn may then be nylon, such as Teflon coated nylon, and the fusible yarn may be a low melt polymer yarn. Alternatively, the fusible yarn may be an impregnated material, such as coated nylon yarn spun around a low melt polymer core yarn. The primary storage chamber 110 may then be formed by way of 3D knitting and then heated over a mold to melt the low melt polymer, which hardens the bag and gives the component a sturdy structure. Further, as discussed below, the secondary yarn can be incorporated as needed by way of I-kat plating techniques, which may include adding the secondary low-melt yarn behind the nylon yarn in prescribed areas during knitting so the inside of the bag hardens and the outside remains soft to touch but still has the hardened structure from the inside plated low-melt yarn.

The techniques described allow the primary storage chamber to remain rigid and keep its form with little or no stretching of the material as users increase the load weight inside the bag. The material choices described and the forming of the structure over a mold, discussed below, creates a finished primary storage chamber in two steps without the use of cutting, sewing, patterning, and adhesion as well as achieving a stiff structure without the use of carcinogenic stiffeners, sprays, and coatings which tend to have overspray and much of which goes to waste.

As shown, the bag assembly 100 is generated when the primary storage chamber 110 is fixed to the carrying structure 120. It will be understood that such fixation may be direct or may be by way of additional structures, such as secondary storage chamber 170. The secondary storage chamber 170 may be, for example, a padded laptop or tablet sleeve with various pockets, such as device organizing pockets. The secondary storage chamber 170 may be a seamlessly knit piece, or it may consist of a mix of cut and sewn sheet material and seamlessly knit 3D panels. This portion may connect both the carrying structure 120 and the storage chamber 110 by way of both sewing and zipper connection points or by a variety of other closure techniques, such as hook and loop or magnetic closures.

Secondary storage 170 may also consist of seamlessly knit custom compartments that are chosen by the user based on personal information about the user or their data inputs about what they carry on a daily basis. These data inputs may be gathered by means of user input, 3D scans, pictures, or measurements into a web based program. In some embodiments, the secondary storage chamber 170 may comprise organization features and may be constructed by way of more traditional manufacturing techniques. In this way, various features unfeasible in 3D knitting construction processes may still be implemented with minimal waste. Some examples of such organization features are discussed below with respect to FIGS. 14-18.

Similarly, the carrying structure 120 is constructed of varying densities of 3D knit spacer knits and mesh structures which create 4-way stretch cushioning that is lightweight and breathable. The straps 130 and the panel 140 are constructed as one seamless piece in the embodiment shown, but may be constructed independently and combined. In some embodiments, the straps 130 and the panel 140 are knitted independently, and are assembled during final assembly.

Generally, in creating the backpack described, the main compartment panel as well as the back panel 140 and shoulder straps 130 of the bag assembly 100 are programmed using computer software, sent to flat-bed knitting machine, and autonomously knit. The main compartment panel is then heated and formed over a shaped mold to set the material, then attached to the back panel and center section of the backpack to form a final usable bag assembly 100. It is understood that all the above components and its variants can be custom made and shaped for each individual user's proportions for an optimal and ergonomic fit/size. Users may input their data and measurements so that components can be tailored to their proportions. This can be done multiple ways such as 3D scanning, inputting measurements into a web based program, pictures of user's body and measurements, etc.

Figure 3:
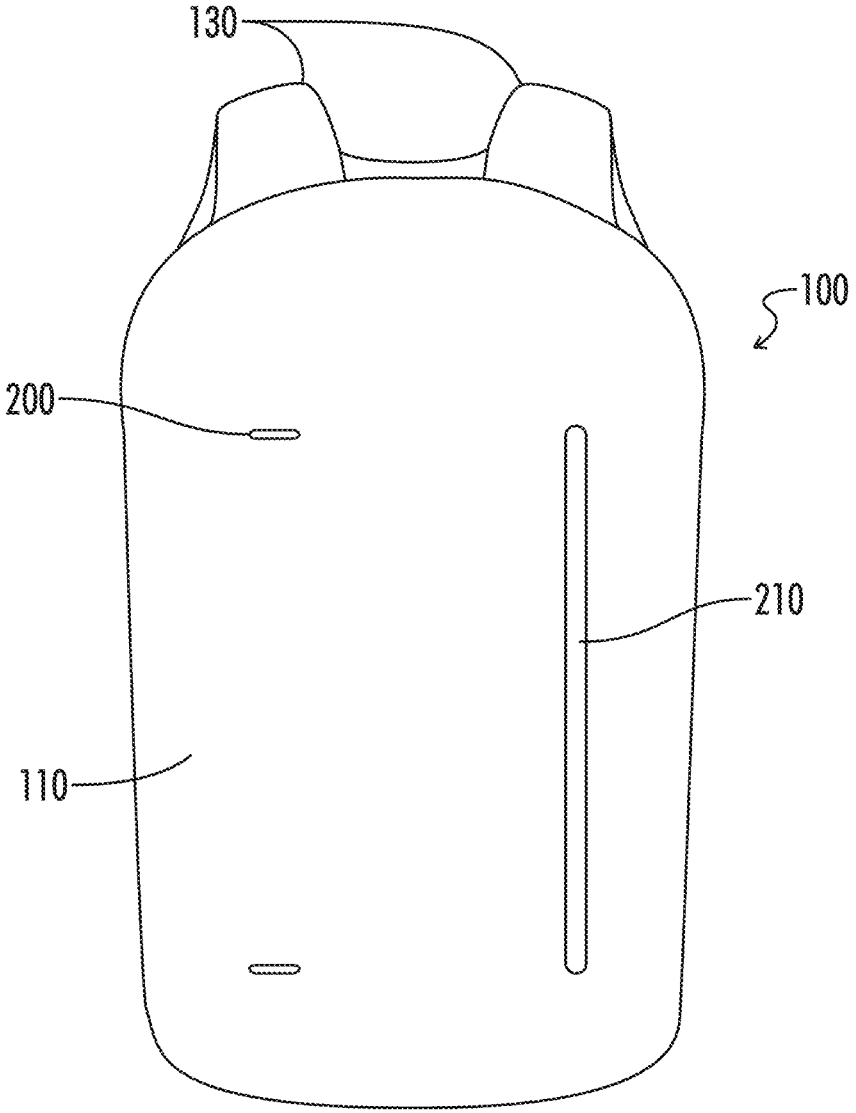
FIG. 3 is a back view of the bag assembly of FIG. 1.
Figure 4:
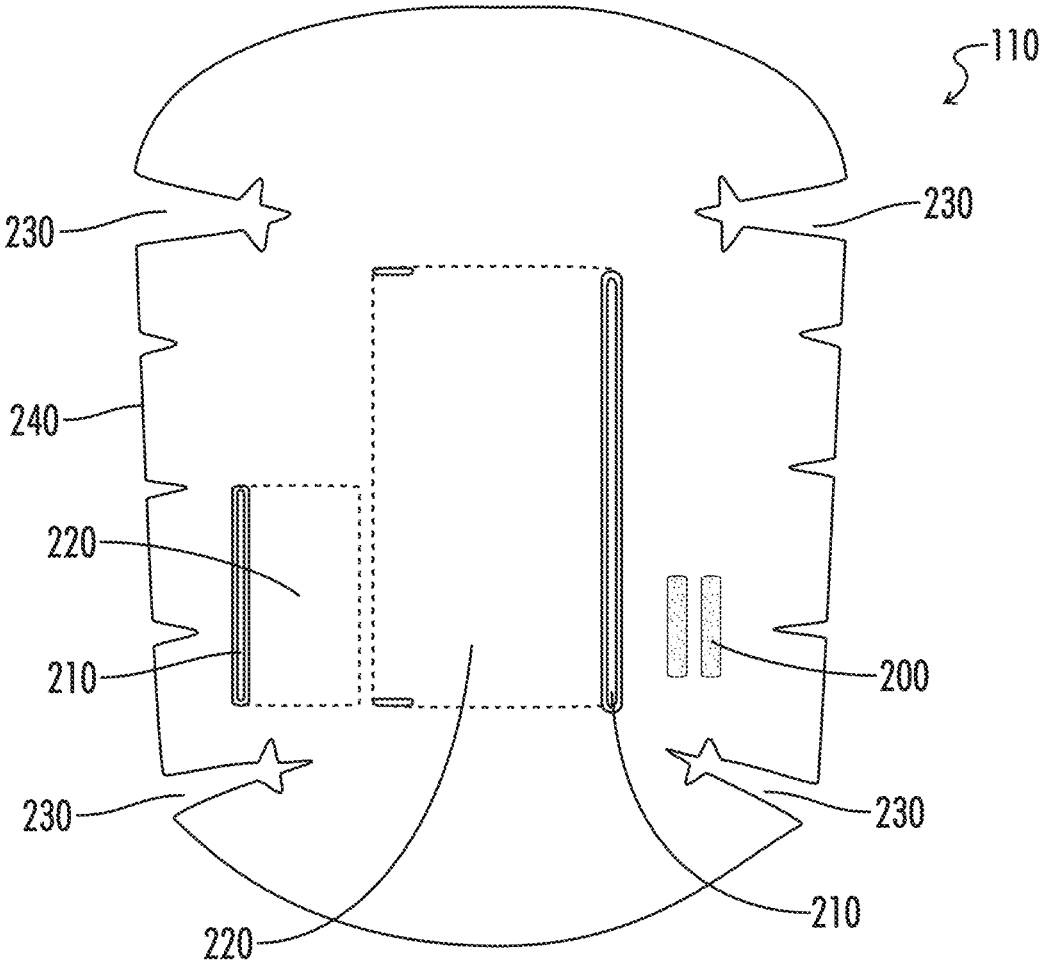
FIG. 4 is a schematic diagram of a primary storage chamber of the bag assembly of FIG. 1.

FIG. 3 is a back view of the bag assembly 100 of FIG. 1, and FIG. 4 is a schematic diagram of the primary storage chamber 110 of the bag assembly. The straps 130 and the primary storage chamber 110 are visible in the picture. As shown, the primary storage chamber 110 may be provided with integrated loops 200 for fixation of accessories to an outside of the chamber. The integrated loops 200 may be supported by a dedicated field generated with an intarsia technique. Multi-field intarsia is the ability to change yarn type, yarn color, material color, stitch density and thickness in different areas across the pattern without having to introduce additional processes. In this way a user may impart many different aesthetic and physical characteristics across one cohesive section. Similarly, ottoman techniques may be used to create seamless multilayer fabric capabilities for features like gear loops and handle straps. Accordingly, several stitching techniques that may be used in the structure described are as follows:

a. Multi-field Intarsia—Ability to incorporate different yarns and features across the backpack pattern using multiple yarn carriers to knit each individual field. Each individual feature and component on the backpack is considered a "field" and requires a dedicated yarn carrier to construct. This is done seamlessly across the width of the backpack pattern without any secondary processes. Saves on labor costs associated with adding and constructing different features through cutting and sewing, as well as material waste.
b. Ottoman Technique & Integral Multi-Layer Knitting—Ability to add desired features and components in specific arrangements throughout the 3D shape of the backpack. Features like pockets, openings, gear loops, handles, etc. are seamlessly and autonomously knit into the backpack structure. Benefits are improved quality, easier production, material savings through less waste, less human error, consistent production, less labor.

As discussed above, the primary storage chamber 110 may be made of various knit structures. In some embodiments, this may be primarily a double layered low-stretch stitch for enhanced durability using nylon mixed with low-melt polymer yarn. The primary storage chamber may be further provided with linear segments 210 not including fusible yarn, such that when the primary storage chamber 110 is heated, such linear segments retain their flexibility and comprise only nylon. As discussed below, such linear segments 210 may be used to incorporate designated bending locations into the primary storage chamber 110. The absence of the fusible yarn in the linear segments 210 may be implemented by way of plating techniques.

a. I-Kat Plating—Traditionally, plating is used to place another yarn (usually of a different color or property) on the inside of the fabric body that is always knit along with the yarn that is seen on the outside of the fabric body. This technique can be further developed to autonomously place specific yarns at prescribed controlled locations (can be placed on the inside or the outside of the fabric body as desired and is independent of the yarn that is seen on the outside of the fabric body) to impart unique characteristics to the backpack. In this embodiment, a layer of low-melt polymer yarn is added behind the nylon yarn of the backpack. This technique is used to stiffen the backpack after it is heated and formed over a mold. The low-melt polymer yarn melts and intertwines with the nylon to create a strong and hardened backpack structure while keeping the outer/exposed surface of the backpack soft and the inner, non-exposed portion of the backpack, stiff and hard. This process replaces the manual act of adding chemical stiffeners and fusible textile materials to a fabric and the cutting, layering, and sewing of these stiffeners to put in-between various textile layers in order to give and keep structure to a backpack/textile.

These sections of nylon with no low-melt polymer can be used to add flexibility to openings, zippers, closures, gear loops, and, as discussed further below with respect to FIG. 21A-D, creates guidelines that help the bag to fold in an optimal fashion while in use, while the rest of the main compartment remains rigid.

As shown, the linear segments 210 may provide access to secondary pockets 220. Such pockets may be added after initial 3D knitting, or they may be incorporated by way of integral knitting techniques. Pockets, gear loops, sleeves, openings, and other features may be integrated during the knitting process. Such techniques allow the creation of multiple features and structures without cutting or sewing. Further, the transitioning between portions that contain the fusible low-melt polymer yarn and portions that are only nylon yarn, such transitions may be by way of targeted knitting, which allows for seamlessly knitting specific materials into specific areas without a need for stopping or adding machinery or incorporating secondary processes to achieve desired attributes.

Accordingly, the linear segments 210 define openings into a storage chamber. The linear segments 210 may then be provided with fixation elements so that the storage chamber, such as secondary pockets 220, can be closed. Such fixation elements may be, for example, a zipper structure, a hook and loop closure, a magnetic closure, and others.

As shown, goreing knitting techniques may be used to give the bag, or components of the bag, a 3D structure. Such techniques allow for certain individual stitches to be held within the needle bed while surrounding structures form, and the structures may then be combined after all are fully formed to create a three dimensional form. This is represented at 230 in the schematic diagram of FIG. 4. Accordingly, in some embodiments, the primary storage chamber 110 may be open on one side, and may form a bowl-like structure, such that it has a rim 240. The rim 240 of the primary storage chamber 110 may then be fixed to a boundary of the panel 140 of the carrying structure 120, such that the panel encloses an interior of the primary storage chamber. Alternatively, the rim 240 may be fixed to the secondary storage chamber 170 and the secondary storage chamber may be fixed to the carrying structure 120. The rim 240 would typically be an integrated knit structure, such as an interlock knit or spacer knit that has a dense structure, but also allows for some four way stretch.

Specially placed goreing zones gives the overall main compartment of the backpack a three-dimensional structure by holding stitches in place while shaping and knitting in other areas, thus creating a 3D structure. This process replaces "darts" which is the act of manually cutting, folding, and sewing a textile to get a three-dimensional structure. Also replaces the manual act of cutting and sewing multiple textile panels/shapes together in order to create an overall three-dimensional structure while adding pockets and other features.

Accordingly, the primary storage chamber 110 may be made up of different knit structures, stitch combinations, and patterns in order to instill specific attributes to different areas of the knit component.

During the knitting of various components, guidelines may be knit into each component for use during final assembly. Such guidelines are typically invisible to the consumer, and act as a map for the laborer during final construction. These guidelines may take the form of subtle stitch variations and patterns in the textile that indicate things like seam allowance for sewing, centering marks for alignment, construction guides for assembly, etc. The act of seamlessly knitting these guidelines into each component saves a significant amount of time and labor during the final construction. No need for measurement tools, physically marking the textile, guessing seam allowance, or guessing alignments of components.

In some embodiments, the rim 240 of the primary storage chamber 110 may be fixed to a boundary of the secondary storage chamber 170, and it may be provided with a segment that can be opened by way of, for example, a zipper closure 250. Alternatively, other forms of closure, such as hook and loop or magnetic closures, may be provided.

Accordingly, the backpack main compartment is formed using a variety of programming techniques that build yarn into a three dimensional textile with seamlessly integrated features such as padding, ventilation, pockets, gear loops, straps, reinforced areas, static stretch sections, flexible sections, and handles. A combination of Teflon coated nylon yarn and a low-melt polymer yarn are combined to form and give the backpack structure. After the knitting process, heat and pressure is applied to the final material, which melts the polymer yarn, thereby intertwining with the nylon yarn and hardening to create a durable and dimensional textile.

The main compartment of the backpack consists of one seamlessly knit three-dimensional piece with integrated features and components such as pockets, zipper openings, gear loops, handles, and finished edges. This is done autonomously using a preprogrammed CAD design that is sent to a flat-bed knitting machine, without any secondary labor processes.

Materials—Main compartment is constructed from a combination of two materials, a primary yarn (nylon) and a secondary yarn (low-met polymer yarn). This dramatically reduces the number of materials, adhesives, stiffeners, coatings, etc. therefore, decreasing waste while increasing the manufacturing efficiency and recyclability of the backpacks afterlife. For example, the materials may include recycled nylon yarns or recycled polymers from recycled water bottles or ocean plastics. Secondary low-melt polymer yarn can also act as a water-repellent after being heated and formed to save on the use of additional coatings.

Additionally, tertiary yarns may be added in prescribed sections as well, on top of, below, or between the primary and secondary yarns. These tertiary yarns could add function in many different ways such as high visibility reflective yarns and luminescent/glowing yarns, photovoltaic yarns to convert sunlight energy into electricity stored on a secondary device, conductive yarns that form sensors/capacitors to collect outside data, conductive yarns for heating and cooling in certain sections, etc. It should be understood that the primary, secondary, and tertiary yarns can be used in a variety of orientations such as independently, combined as separate yarns that are next to each other, or combined within a single yarn through the use of twisting prescribed materials over core materials to create a single yarn with multiple materials attributes in it.

Figure 5:
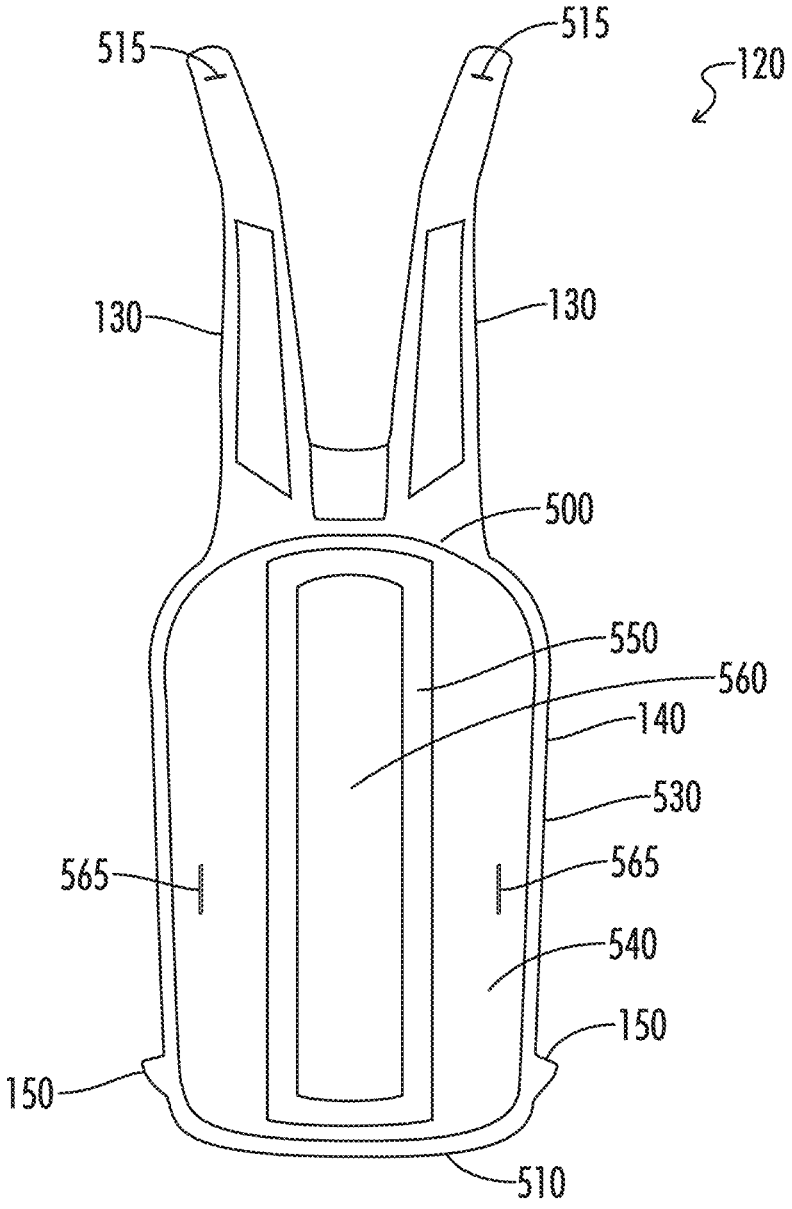
FIG. 5 is a schematic diagram of a carrying structure of the bag assembly of FIG. 1 comprising a back panel and shoulder straps.

FIG. 5 is a schematic diagram of a carrying structure 120 of the bag assembly 100 of FIG. 1. As shown, the carrying structure comprises at least one strap 130, typically two straps in a backpack, and a panel 140. The panel 140 has a first end 500 and a second end 510, and the straps 130 are seamlessly integrated into the first end. The panel 140 further comprises wings 150 integrated into or adjacent the second end 510. A linking strap 160 (not shown in FIG. 5) may be provided linking the straps 130 to the wings 150 to form a shoulder strap that can be used for wearing the backpack shown. The straps 130 may be provided with slots 515 for retaining the linking strap 160 when fully assembled.

The carrying structure 120 is designed with various knit techniques and stitch structures to impart specific attributes and functions in specific sections. The straps 130 are typically knit using an air-permeable mesh structure that has a controlled amount of stretch to act as a load/shock absorbent structure as the user moves and adds weight to the bag assembly 100. Similarly, the straps 130 may have a knit mesh variation around the users neckline with a high amount of 4-way stretch as well as breathability to conform to the users unique neckline while remaining breathable and load bearing. This is discussed in more detail with respect to FIGS. 13A-13B.

The back panel structure 140 utilizes a variety of knit structures to impart various attributes such as a low-stretch breathable knit structure around the boarder for breathability and structure. Further, as shown in FIG. 12B, discussed below, the varying of knit structures may be implemented for aesthetic purposes. The overall structure carrying structure 120 is a combination of both the straps 130 and the panel 140 which can be seamlessly knit as one piece or as separate pieces that are joined during construction. The multiple knit variations found within carrying structure 120 impart various attributes to specific sections of the structure. It is understood that carrying structure 120 and its various components can be custom made and shaped for an individual user's proportions for an optimal and ergonomic fit. Users input their data and measurements so that components can be tailored to their proportions. This can be done multiple ways such as 3D scanning, inputting measurements into a web based program, pictures of users body and measurements, etc.

As shown, the panel 140 is made from a variety of knit structures implemented using various 3D knitting techniques. The panel 140 comprises a dense and stiffened spacer knit forming an outer boundary 530 around the back panel, and the straps 130 are seamlessly fixed to the outer boundary. In such an embodiment, at least a portion 540 of the panel 140 inside the outer boundary 530 and at least a portion of the straps 130 are formed from spacer knits less dense and less stiff than the outer boundary.

The panel 140 may further comprise a second dense and stiffened segment forming an inner boundary 550, and the inner boundary may encompass an inner segment 560 of the panel 140. In such an embodiment, the outer boundary 530 and the inner boundary 550 may combine to define a channel therebetween, the channel comprising the portion 540 inside the outer boundary. The inner segment 560 may then comprise a porous knit structure that allows for breathability.

Accordingly, in the overall bag assembly 100 of FIG. 1, each component may be constructed from a variety or combination of knit structures, stitches, and patterns to impart various attributes to specific zones of the textile. The positioning of these knit components may be custom tailored to users based on their personal data, such as size, or based on their needs, such as what they typically carry.

Accordingly, the back panel and shoulder straps may consist of one seamlessly knit three-dimensional piece, made up of varying densities of spacer knit and elastic mesh knit structures. Spacer knit structures are used to add padding while facilitating breathability, moisture wicking, and four-way stretch capabilities without the use of foams, cutting, sewing, adhering, and layering. Elastic mesh knit structures are designed to create four-way stretch air-flow passages and allow the back panel to conform to the users body, creating a more ergonomic and natural carrying experience. This is done autonomously using a predetermined CAD design that is sent to a flat-bed knitting machine, without any secondary labor processes.

While the embodiment shown incorporates straps 130 integrated into the panel 140, in some embodiments, the straps and panel may be independent structures bonded together. Further, the panel 140 may incorporate additional features, such as slots 565 for supporting additional components, such as a luggage strap for strapping the backpack 100 to rolling luggage.

Materials—The back panel and shoulder straps are generally constructed from a combination of two materials, a primary yarn, which may be an elastic polyester, and a secondary yarn, which may be monofilament or a variety of other types of yarns depended on desired characteristics. In some embodiments, only a primary nylon yarn from the main compartment is used, and an elastic yarn is used in small sections. In such embodiments, there may be no use of a monofilament. This dramatically reduces the number of materials, adhesives, stiffeners, coatings, etc. therefore, decreasing waste while increasing the manufacturing efficiency and recyclability of the backpacks afterlife. The selection of a proper spacer knit and stitch may be adjusted to provide proper cushioning, breathability, and stretch.

Figure 6:
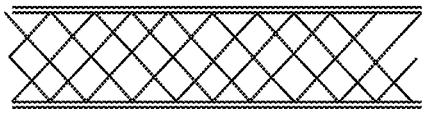
FIG. 6 is a first spacer knit used in the bag assembly of FIG. 1.

FIG. 6 is a first spacer knit used in the bag assembly 100 of FIG. 1. The spacer knit shown may be used for the portion 540 of the panel 140 inside the outer boundary 530 as well as portions of or the entirety of the straps 130. In some embodiments, the knit may be made of elastic yarn and monofilament and may be approximately ½ inch thick, and may create a breathable cushion that replaces the use of urethane foams. Such a knit may be a breathable plush cushioning that wicks moisture from the surface under it, such as the user's back.

Accordingly, the shoulder straps may be constructed of a three-dimensional spacer knit. The spacer knit is made up of two individual layers that are connected by a thick gap of criss-crossing strands of yarn, which creates a lightweight cushioning without the use of urethane foams and material layering. The two-layer construction allows the textile to be air-permeable, moisture wicking, and breathable in order to prevent the build-up of heat and sweat. The stitch pattern used to construct the spacer knit is engineered to give the shoulder straps 4-way stretch capabilities in order to conform the straps to the users shoulders for a more secure, healthy, and ergonomic fit while remaining moisture wicking. Further, the fit may be customized to a user, thereby further improving the ergonomics of the bag assembly 100.

Figure 7:
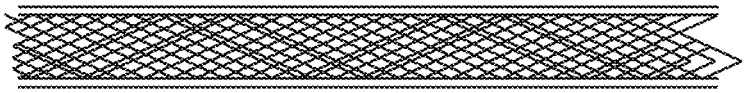
FIG. 7 is a second spacer knit used in the bag assembly of FIG. 1.

FIG. 7 is a second spacer knit used in the bag assembly 100 of FIG. 1. The second spacer knit is stiffer than that shown in FIG. 6, and may create a frame-like structure to hold shape and create air channels. Such a knit may be used, for example, in the outer boundary 530 and the inner boundary 550 of the panel 140.

Figure 8:
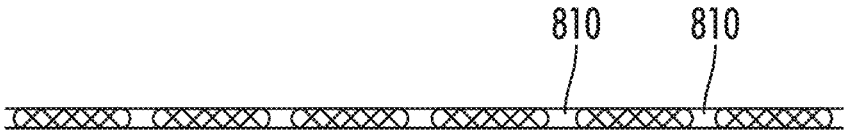
FIG. 8 is a mesh knit used in the bag assembly of FIG. 1.

FIG. 8 is a mesh knit used in the bag assembly of FIG. 1. The mesh knit may comprise only nylon yarn, and may be a pointelle mesh structure that creates a breathable air channel which may include holes 810 for air to flow through. Such a knit may be used, for example, for the inner segment 560 of the panel 140.

Figure 9:
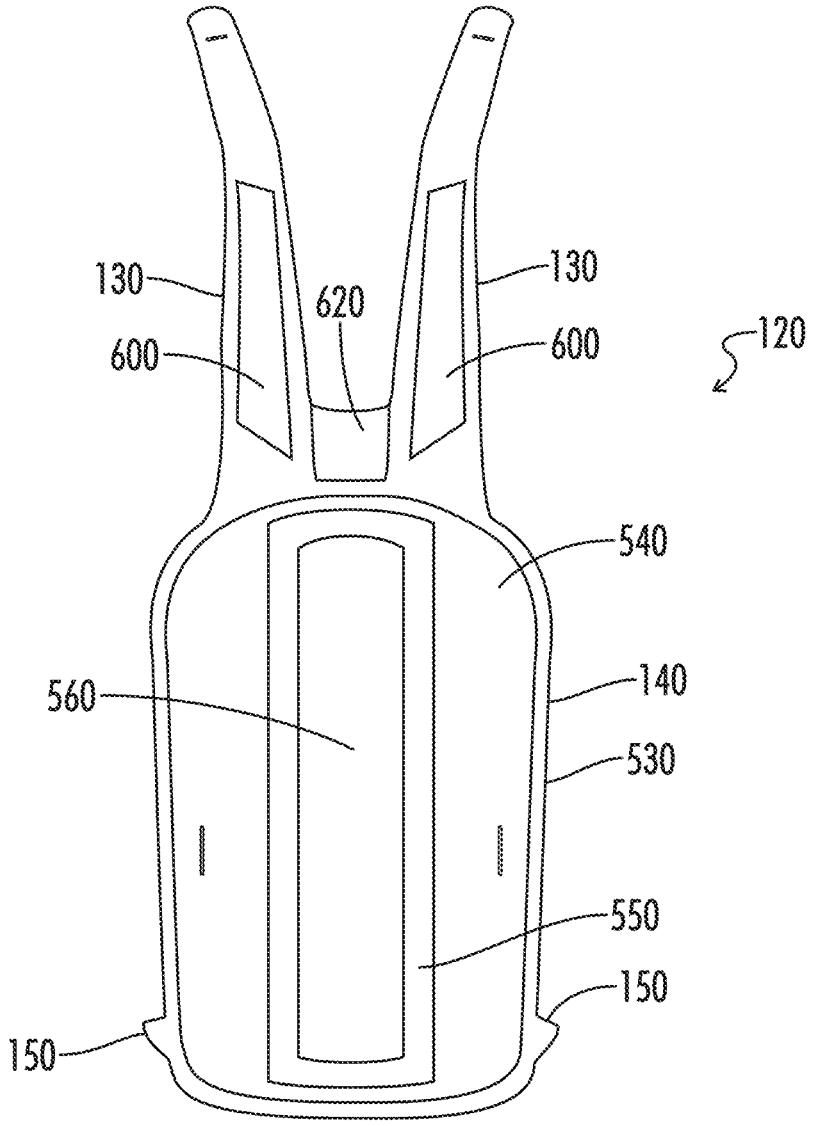
FIG. 9 is a schematic diagram of an alternative embodiment of a carrying structure for use in the bag assembly of FIG. 1.

FIG. 9 is a schematic diagram of an alternative embodiment of a carrying structure 120 for use in the bag assembly 100 of FIG. 1. As shown, the carrying structure 120 shown in FIG. 9 may provide a more sophisticated and complex array of structures, which may then provide a more comfortable fit for a user.

As shown, the carrying structure 120 may be provided with the straps 130 and panel 140 as shown in FIG. 6, as well as the wings 150 and linking strap 160. The panel may similarly be provided with the outer boundary 530 and inner boundary 550 formed from a dense and stiffened spacer knit, as well as the portion 540 of the panel 140 between the inner and outer boundaries formed of a less dense spacer knit. It may be further provided with the inner segment 560 comprising a porous knit structure, such as that shown in FIG. 8, for example.

Further, the shoulder straps 130 may be provided with ventilation segments 600, which may be made of the same porous knit structure as the inner segment 560. Further, in order to create a larger breathable section in the panel, the inner segment 560 may be surrounded with a secondary inner segment (not shown) that is still porous and breathable, but is thicker and more structural than the inner segment 560 and the ventilation segments 600.

In order to increase comfort for a wearer, a section 620 adjacent a wearer's neck between the shoulder straps 130 may similarly be made of the same material as the ventilation segments 600. Section 620 may be knit with all nylon for a softer spacer mesh since it will sometimes be against users neckline or skin during use. This spacer mesh is engineered to have a soft finished edge, a higher amount of 4-way stretch than the surrounding knit structures so it can conform to the users neckline, and an engineered pointelle mesh structure that lets air freely move for maximum breathability.

The wings 150 may be made of a thick 2-ply nylon knit structure for increased strength, and the linking straps 160 may be made of an adjustable poly webbing sewn to the wings and connected to the shoulder straps. In some embodiments, the wings 150 may be modified to generate a different angle of carry, which may be based on and customized for a user's height or other personal characteristics.

While specific configurations are shown, the configurations may be varied by changing the stitch density, thickness, and materiality in locations other than those shown. This can be done autonomously throughout the pattern in order to integrate desired attributes. Many, or all of the materials comprising the carrying structure may have 4-way stretch properties, as well as moisture wicking and breathability, cushioning, and reinforcement. The segments may be more or less stretchable based on the knit structure used and desired attributes in that area.

The shapes of the structure may be changed by autonomously adding stitches to the overall structure in order to create a desired shape. This may be useful in order to stitch different size bags or custom bags for users as desired. Similarly, stiches may be subtracted in locations in order to narrow segments of the material, such as in order to control the taper of the shoulder straps 130, back panel 140, or other components. Such widening and narrowing allows for seamlessly changing the shape of the textile without cutting or sewing. Widening or narrowing the backpack structure creates a desired shape while keeping a finished edge. This process replaces manual cutting, trimming, layering, and sewing pieces of textiles to create a desired shape.

Accordingly, the back panel is constructed of varying thicknesses of moisture wicking spacer knit to provide an all over breathable cushioning material with airflow channels to direct hot air away from the body. The multi-layer spacer knit also provides added protective cushioning for users internal electronics such as laptops, tablets, phones, etc. without the use of stiffeners, urethane foams, or material layering and joining.

Figure 10A:
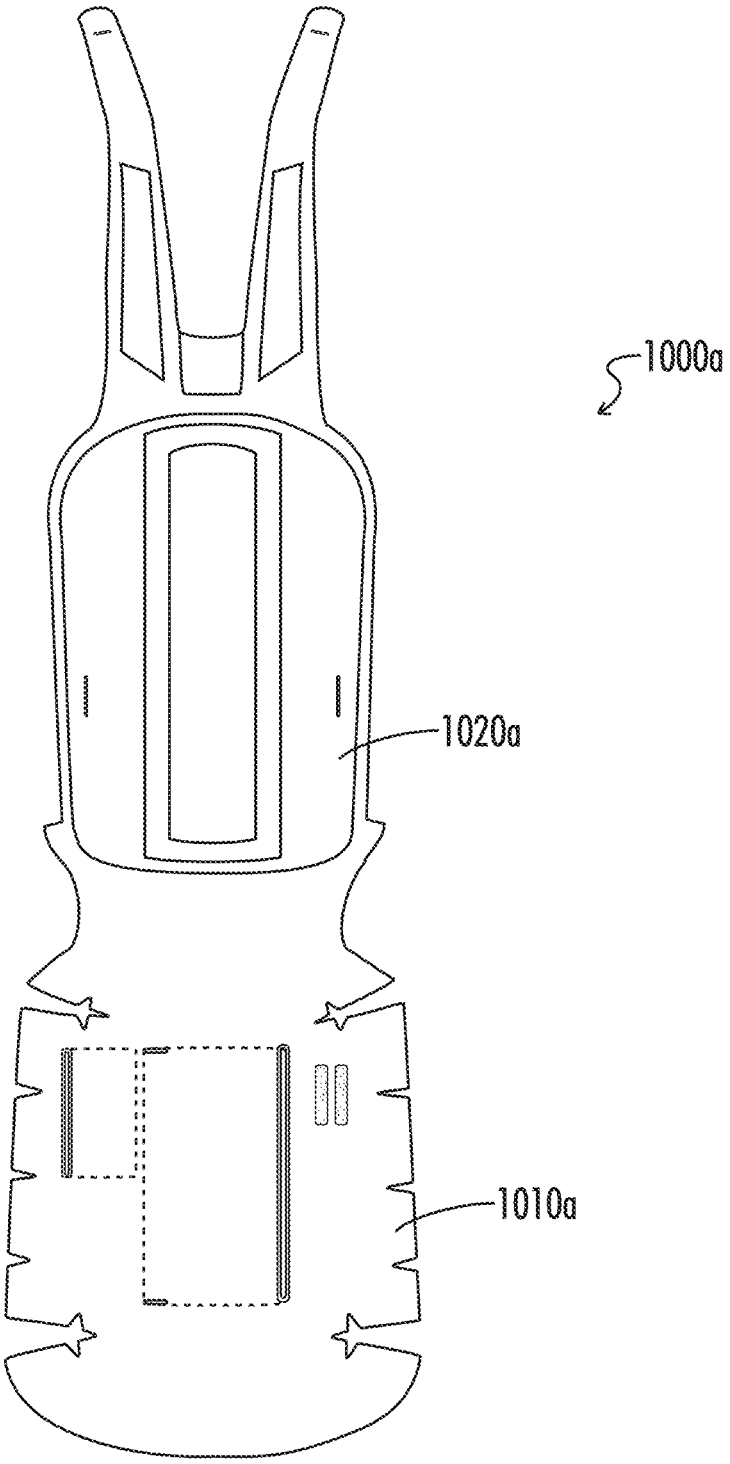
FIG. 10A is an alternative embodiment of a bag assembly in accordance with this disclosure.
Figure 10B:
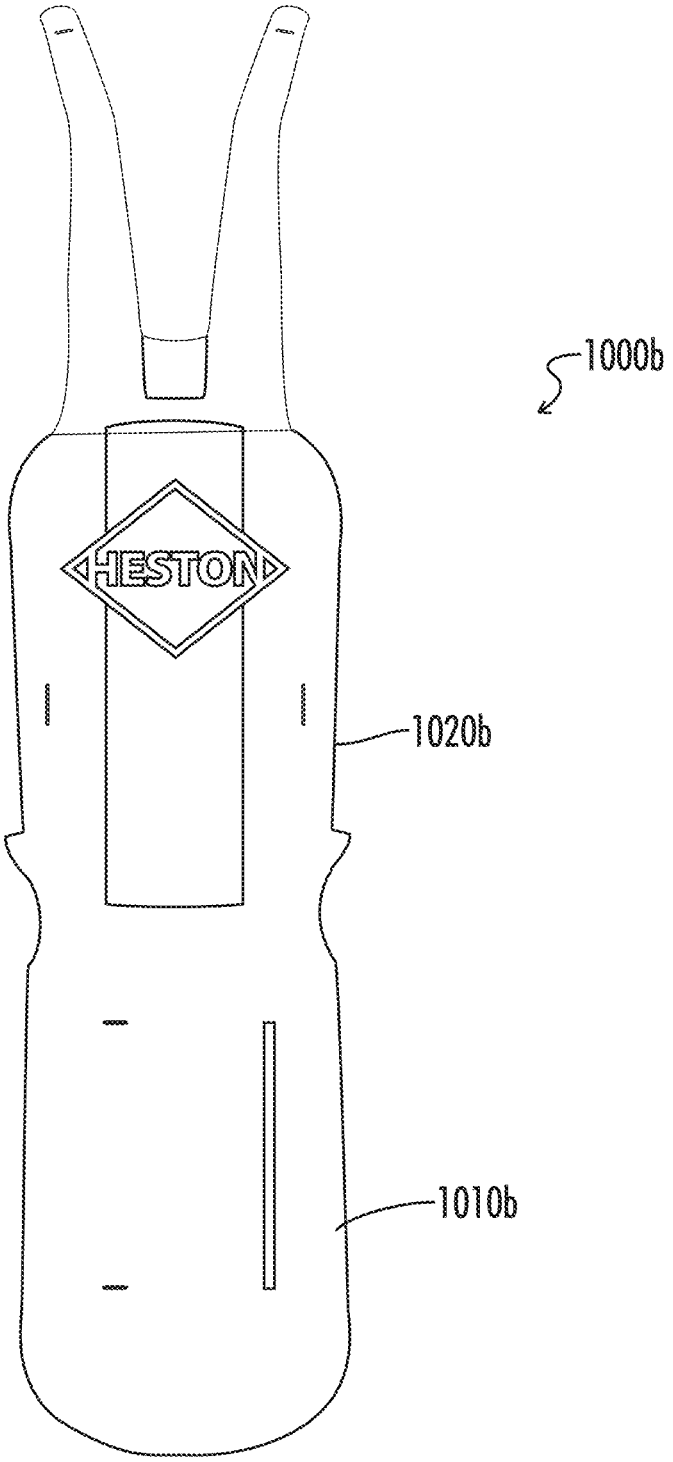
FIG. 10B is another alternative embodiment of a bag assembly in accordance with this disclosure.
Figure 10C:
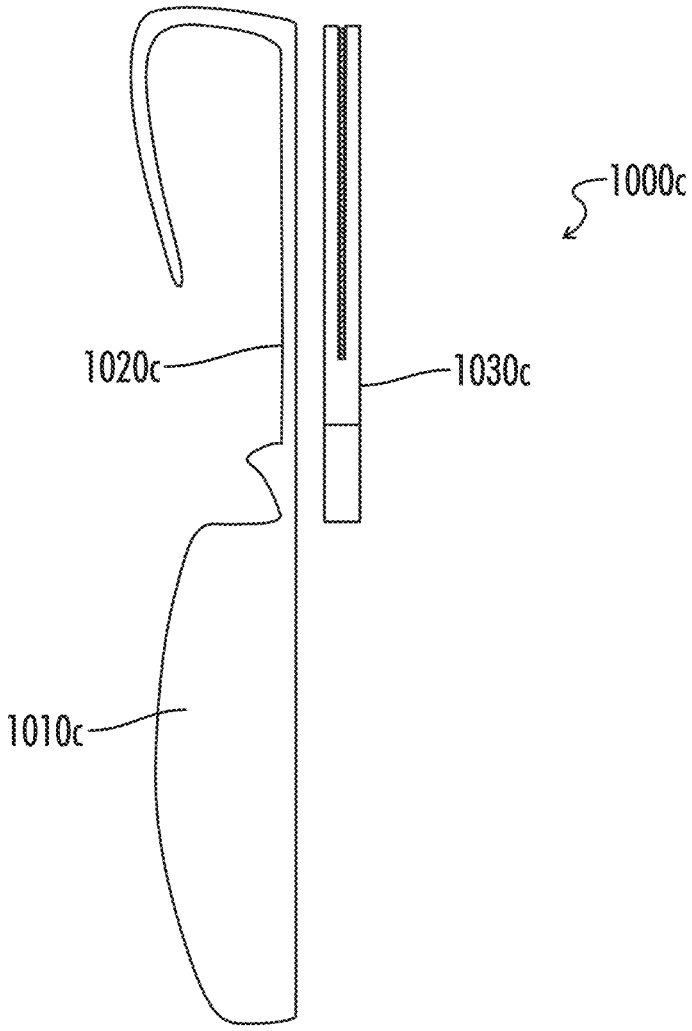
FIG. 10C shows the assembly of the embodiment of 10B into a bag.

FIGS. 10A, 10B, and 10C are alternative embodiments of bag assemblies 1000*a, b, c* in accordance with this disclosure. As shown, carrying structures 1020*a, b, c* and the primary storage chamber 1010*a, b, c* are formed from a single 3D knit sheet. In such an embodiment, the single sheet may comprise sections corresponding to each of the components described above, and upon final assembly, the sheet may be folded over itself to form a finished structure. Further, as shown in FIG. 10C, the carrying structure 1020*c* and the primary storage chamber 1010*c* may be wrapped around a secondary storage chamber 1030*c*, thereby forming a complete backpack 1000*c*.

In some embodiments, inverse plating techniques may be used to constantly switch yarns from front to back within the same knitting course in order to impart structure, texture variations, integrated features, design motifs, and unique properties. Stitch Variation techniques may provide an ability to change stitch density and thicknesses in specific areas throughout the backpack pattern without having to introduce new materials through cutting and sewing. This can result in seamless or fully-fashioned construction by providing an ability to move and form stitches in a desired array to form a seamlessly shaped structure. This is obtainable through flat-bed knitting compared to any other type of knitting or weaving.

Figure 11:
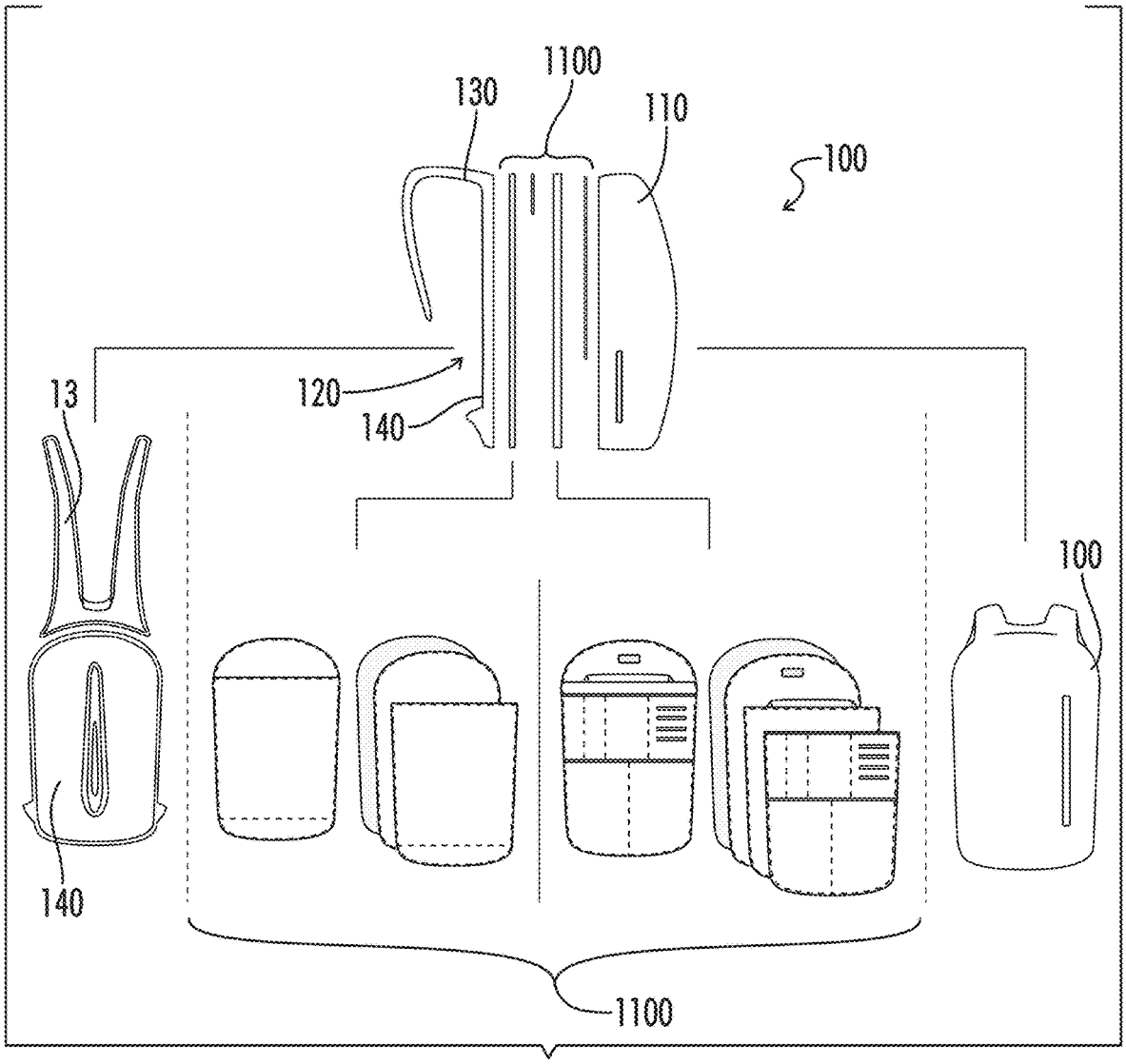
FIG. 11 is an exploded view of another alternative embodiment of a bag assembly in accordance with this disclosure.

As shown in FIG. 11, the bag assembly 100, while generally comprising the primary storage chamber 110 and the carrying structure 120, and with the carrying structure 120 comprising the straps 130 and the panel 140, may be constructed in a variety of ways, and the components may be divided in different ways. For example, while the carrying structure is generally discussed as a single knit component comprising a panel and at least one strap, the straps may instead be knit as a separate component and then fixed to the panel.

Further, as shown, a variety of internal components 1100 and configurations may take the place of the secondary compartment 170 discussed above with respect to FIG. 1.

Figure 12A:
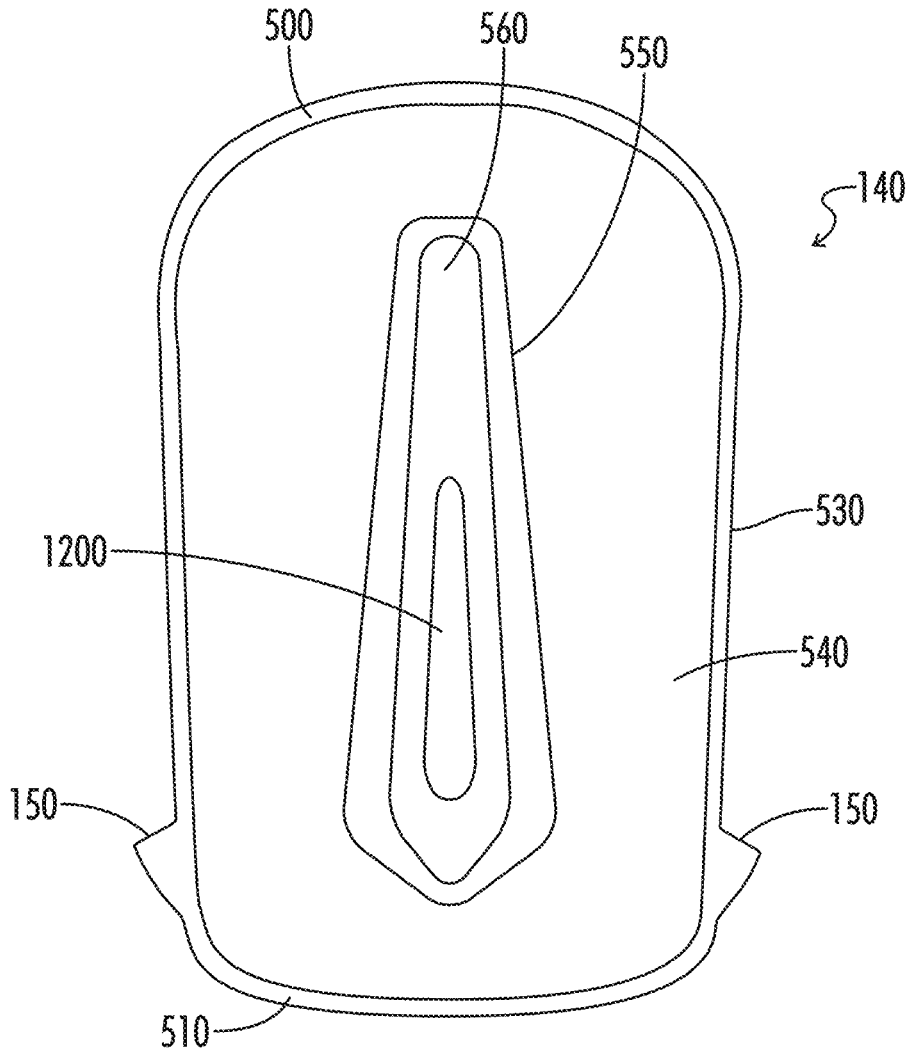
FIG. 12A is a drawing of one embodiment of a back panel as a component of a carrying structure for use in the bag assembly of FIG. 11.
Figure 12B:
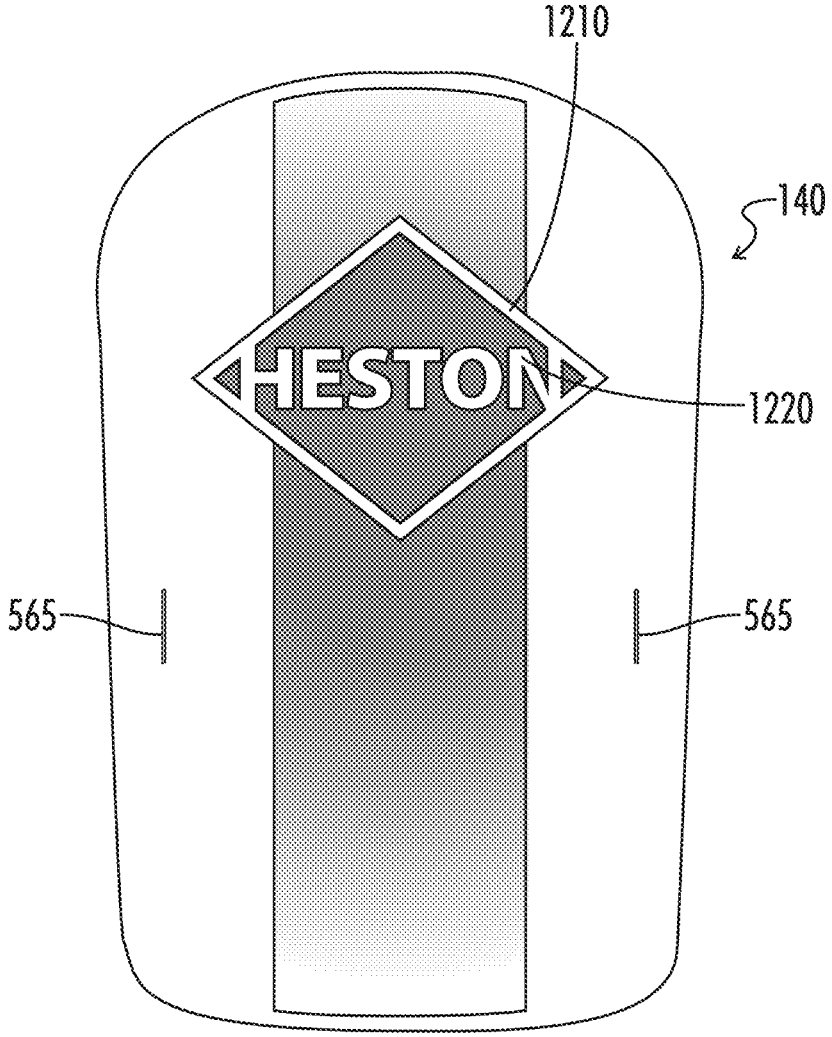
FIG. 12B is second embodiment of a back panel as a component of a carrying structure for use in the bag assembly of FIG. 11.

Accordingly, FIG. 12A shows a back panel 140 used in the bag assembly 100 as shown in FIG. 11. As shown, the back panel 140 continues to have a first end 500 and a second end 510, and the straps are integrated into the first end. The panel may then have wings 150 integrated into or near the second end 510. Further, as in the embodiment discussed above with respect to FIGS. 5 and 9, the panel 140 comprises a dense and stiffened spacer knit forming an outer boundary 530 around the back panel and has a further portion 540 inside the outer boundary 530 that are formed from spacer knits less dense and less stiff than the outer boundary. Further, an inner boundary 550 may be provided which encompasses an inner segment 560 of the panel 140, with a channel defined therebetween comprising the portion 540 inside the outer boundary 530.

As shown, additional distinct segments may be provided. For example, the inner segment 560 may include, or encompass, a secondary inner segment 1200 that is still porous and breathable, but thicker and more structural than the inner segment 560. These various segments may be adjusted and located in order to increase comfort of an end user, and may be located based on custom measurements received from an end user.

As shown in FIG. 12B, the various segments, including additional secondary inner segments, may be located for design purposes. For example, an additional inner segment 1210 may be located towards the middle of the panel 140 in order to incorporate a custom logo design which may then be seamlessly knit into the panel with a high-stretch rib structure forming the logo and allowing it to conform to the user's body type. The negative space 1220 within the logo may then be constructed using a fully-permeable mesh that allows air to disperse and adds breathability, keeping the user's back cool while providing a snug fit. Engineered areas of fully breathable mesh may be seamlessly knit into specific areas throughout the back panel to pull hot air away from the user's body. Also incorporated into the panel 140 are seamlessly knit openings 565 where a piece of webbing can be secured without the use of cutting and layering. These openings when combined with the webbing acts as a secure structure that can be placed over the handles of rolling luggage while not wearing the bag or in transit. Similarly, features can be seamlessly knitted throughout the strap structure such as gear loops, handles, pockets, sleeves, padding and cushioning.

Figure 12C:
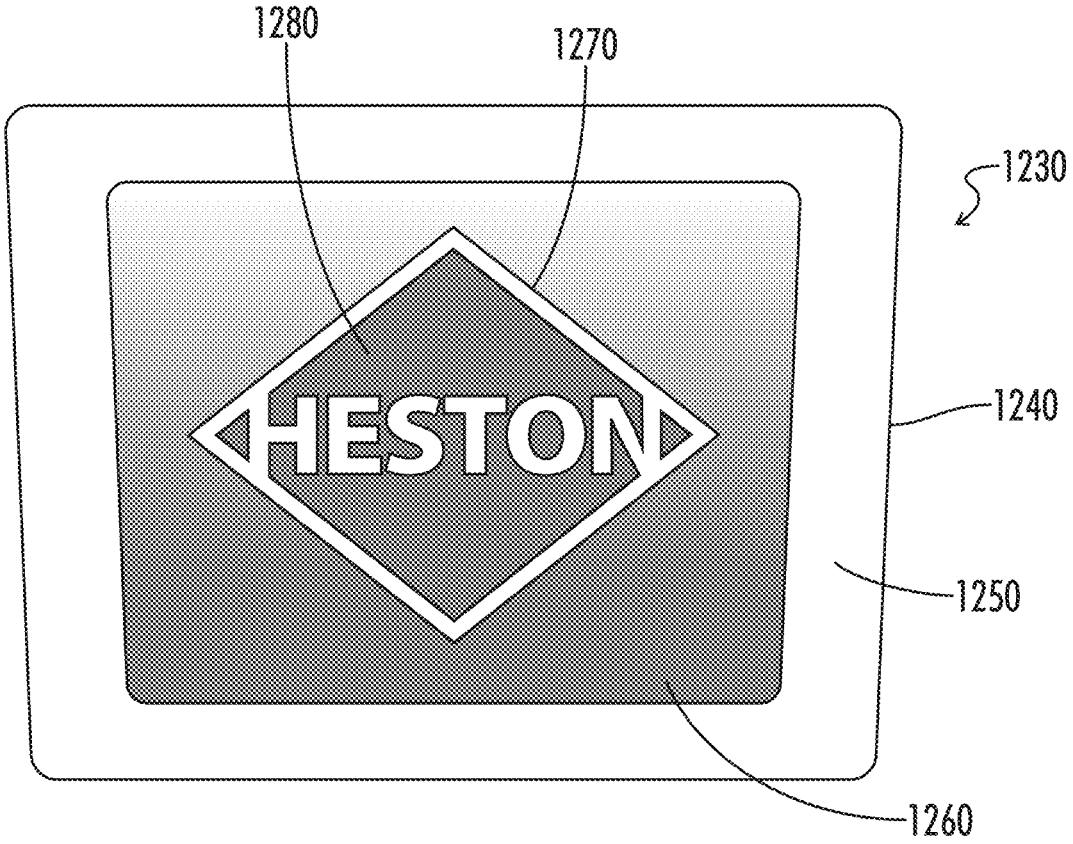
FIG. 12C is an embodiment of a back panel as a component of an alternative embodiment of a bag assembly in accordance with this disclosure.

As shown in FIG. 12C, while the bag is generally shown and described in terms of a backpack 100, it will be understood that the claimed features may be incorporated into a wide variety of bag styles. Accordingly, FIG. 12C shows a messenger bag 1230 incorporating a back panel 1240 similar to that discussed above. Accordingly, the panel 1240 may incorporate an outer boundary 1250 around the back panel formed from a dense and stiffened spacer knit, and it may incorporate a further portion 1260 inside the outer boundary 1250 that is formed from spacer knits less dense and less stiff than the outer boundary.

Further, an inner boundary 1270 may be provided which encompasses an inner segment 1280 which may incorporate a lighter stitch and may be formed in a custom design, such as a logo.

Further, as shown in both FIGS. 12B and 12C, portions of the panel may include a gradual transition between knit textures. Accordingly, the further portion 1260 may vary from a less air-permeable knit pattern to a more air-permeable knit pattern in order to have components of the bag that rest on a user's body be maximally air permeable.

Figure 13A:
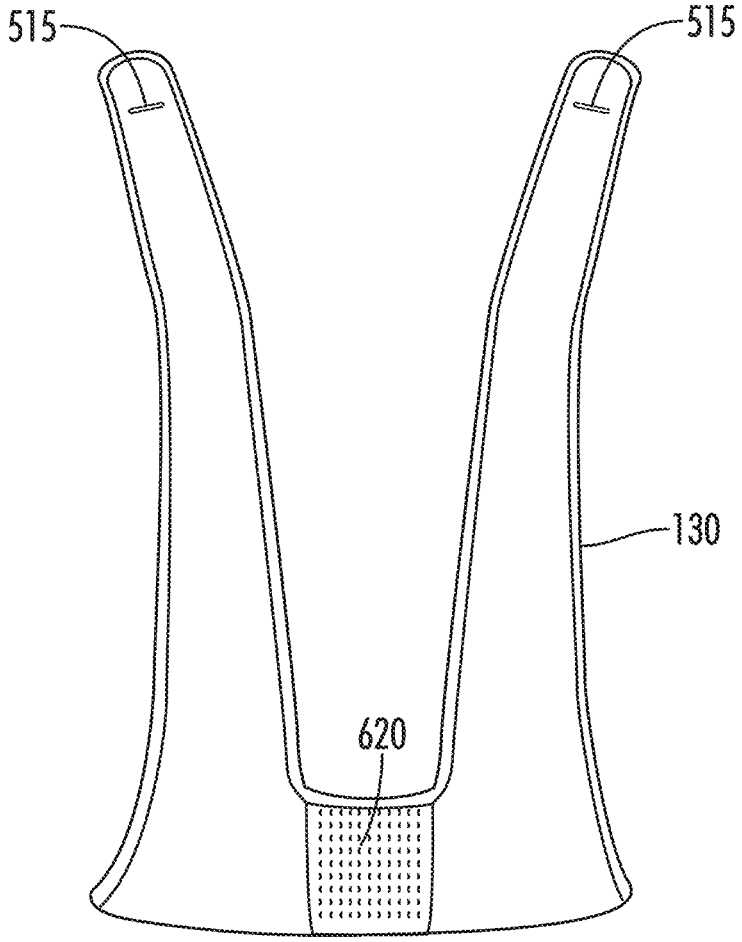
FIG. 13A is a drawing of one embodiment of a strap as a component of the carrying structure for use in the bag assembly of FIG. 11.

Accordingly, FIG. 13A shows an embodiment of a strap 130 as a component of the carrying structure 120 for use in the bag assembly shown in FIG. 11. As shown, the straps 130 may also have integrated knit openings 515 at their ends where webbing can be incorporated without the use of cutting and layering reinforcement material, so that the carrying level/angle of bag can be adjusted. These knit openings can also be incorporated throughout the straps to incorporate other outside hardware without cutting and layering. Similarly, features can be seamlessly knitted throughout the strap structure such as gear loops, handles, pockets, sleeves, padding and cushioning.

Further, as discussed above with respect to FIG. 9, in order to increase comfort for a wearer, a section 620 adjacent a wearer's neck between the shoulder straps 130 may be made of a more air-permeable material.

Figure 13B:
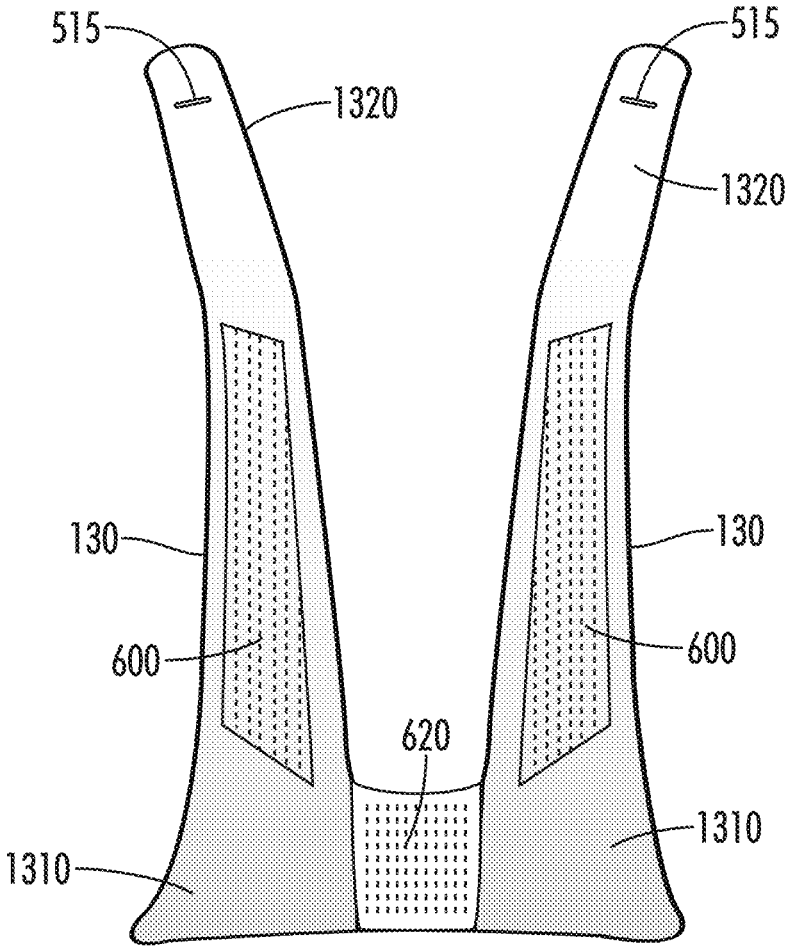
FIG. 13B is a second embodiment of a strap as a component of the carrying structure for use in the bag assembly of FIG. 11.

As shown in FIG. 13B, the straps 130 may be provided with ventilation segments 600, such as those discussed above with respect to FIG. 9. Further, the straps may include a gradual transition between knit textures from a more air-permeable texture at a first end 1310 to a less air-permeable texture at a second end 1320, as discussed above with respect to FIGS. 12B-12C. Accordingly, the combination of engineered stitch patterns and stitch variations act as a variable stretch system that adjusts itself as the weight of the backpack changes, acting as a load bearing system that distributes the weight of the bag evenly over the user's shoulder and back.

Figure 13C:
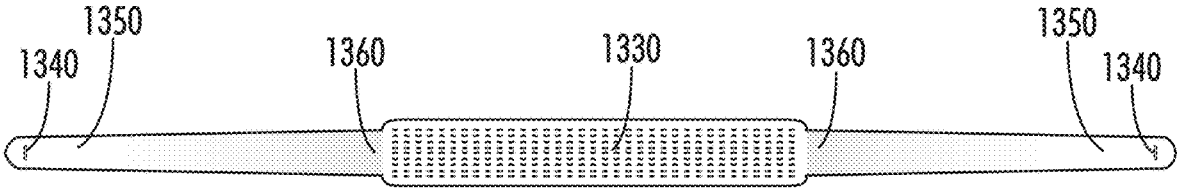
FIGS. 13C and 13D show an embodiment of a strap as a component of an alternative embodiment of a bag assembly in accordance with this disclosure.
Figure 13D:
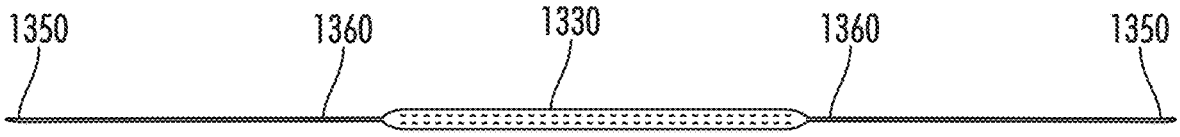

FIGS. 13C and 13D shown an embodiment of a strap as a component of an alternative embodiment of a bag assembly in accordance with this disclosure, such as the messenger bag 1230 discussed above with respect to FIG. 12C. As shown, the strap may be provided with a padded breathable spacer mesh forming a shoulder pad 1330 as well as knit slots 1340 to secure the strap to appropriate hardware.

The strap may then be provided with a slowly transitioning knit structure, such as that discussed above with respect to FIGS. 12B, 12C, and 13B, such that they transition from a static or low stretch knit structure at the lateral ends 1350 to a more elastic knit at the portions of the strap 1360 adjacent the shoulder pad 1330.

Figure 13E:
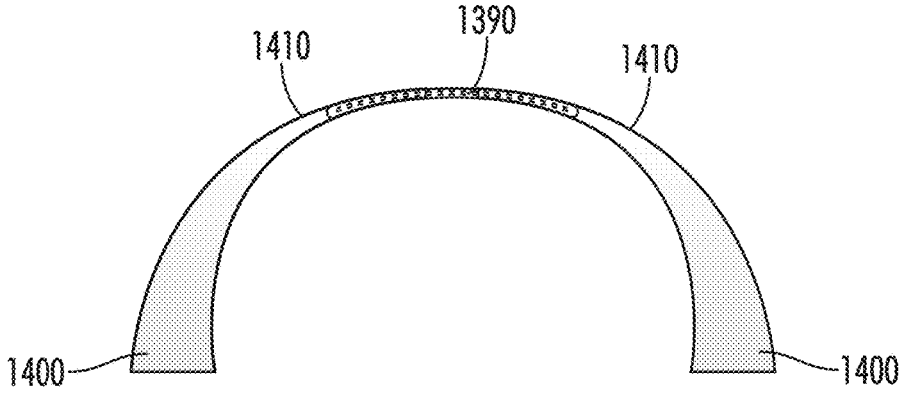
FIG. 13E shows an alternative embodiment of a strap as a component of a bag assembly in accordance with this disclosure.
Figure 13F:
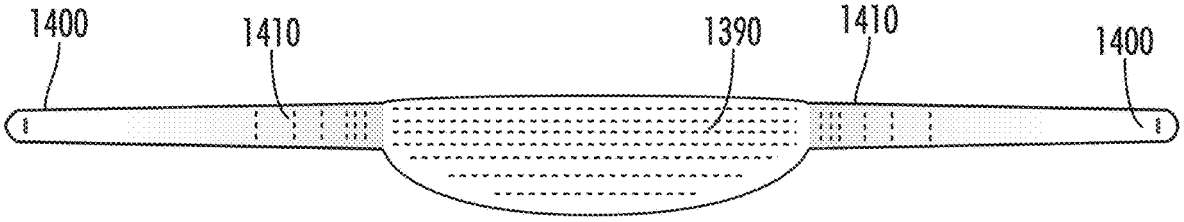
FIG. 13F shows an alternative embodiment of a strap as a component of a bag assembly in accordance with this disclosure.
Figure 14:
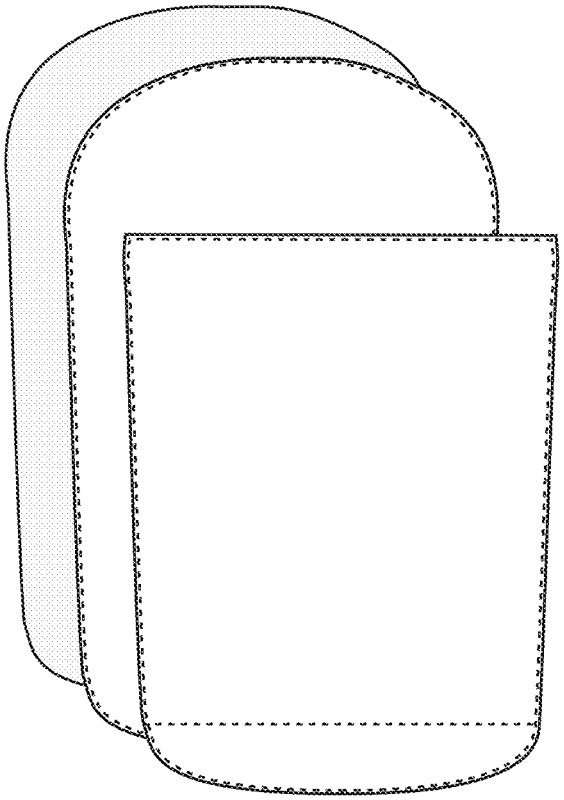
FIG. 14 is an exploded view of a secondary pocket segment for use in the bag assembly of FIG. 11.
Figure 15:
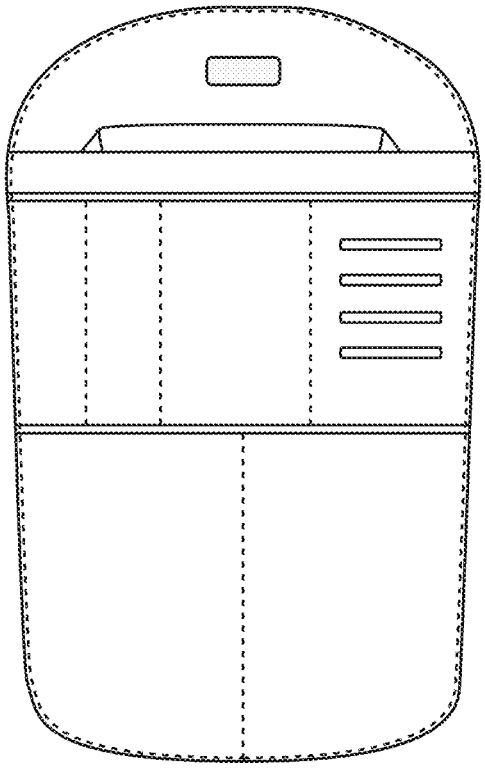
FIG. 15 is a view of an additional secondary pocket segment for use in the bag assembly of FIG. 11.
Figure 16:
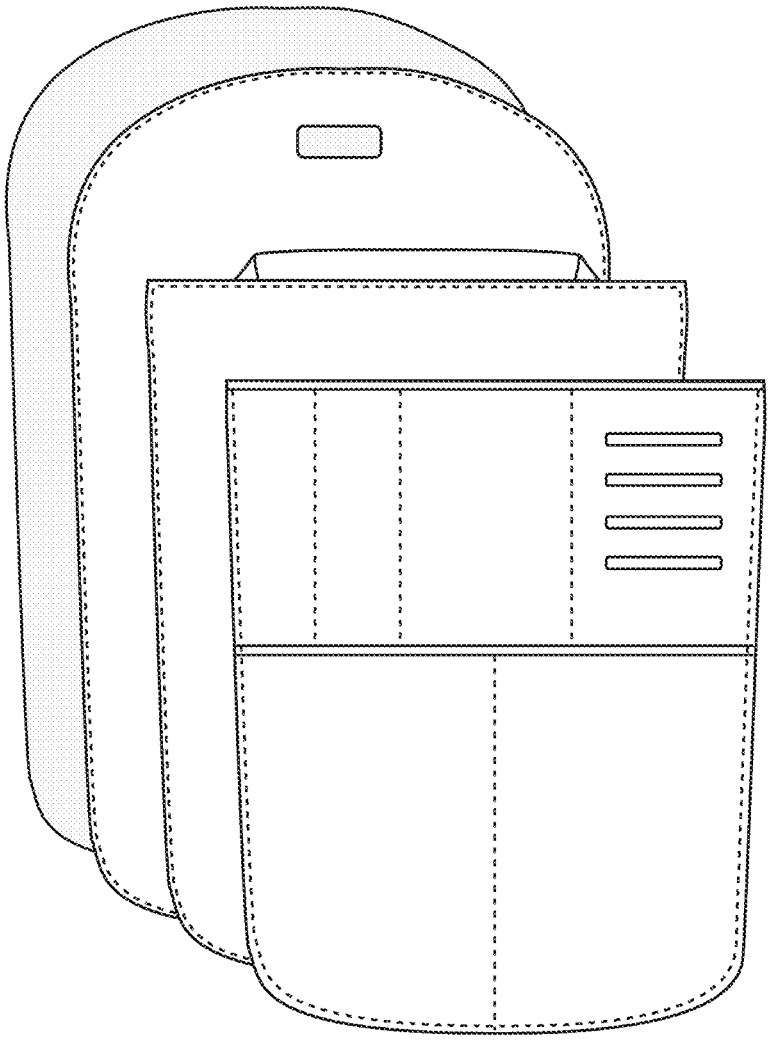
FIG. 16 is an exploded view of the secondary pocket segment shown in FIG. 15.
Figure 17:
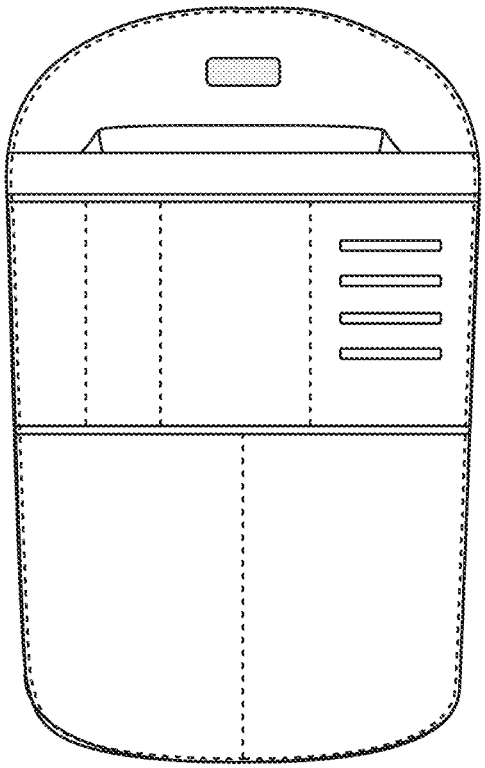
FIG. 17 is a view of the secondary pocket segment shown in FIG. 15 with certain elements emphasized.
Figure 18:
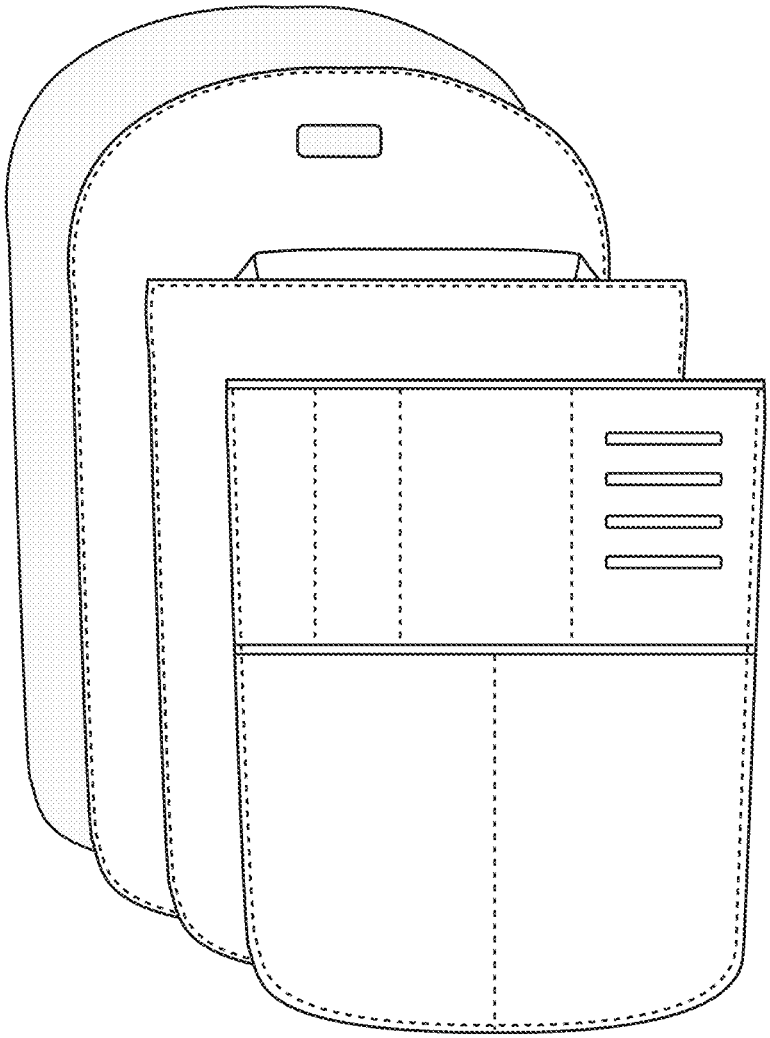
FIG. 18 is a view of the secondary pocket segment shown in FIG. 15 with certain elements emphasized.

FIG. 13E shows an alternative embodiment of a strap 1370 as a component of a bag assembly in accordance with this disclosure, and FIG. 13F shows a further alternative embodiment of a strap 1380 as a component of a bag assembly in accordance with this disclosure. In each of these examples, the strap has a central pad 1390 and a strap segment that extends from a static or low stretch knit at lateral ends 1400, which connect to the bag being supported by the strap, to a more elastic knit at portions 1410 adjacent the central pad 1390.

FIGS. 14-18 show partially exploded views of internal pockets for use in the bag assembly 100 of FIG. 11, discussed above.

Figure 19A:
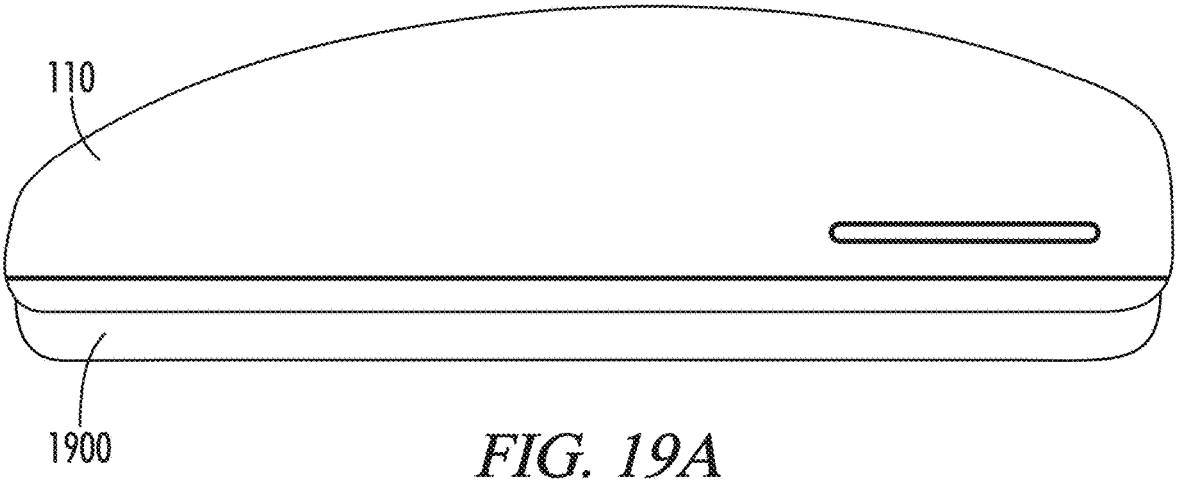
FIG. 19A is a view of a primary storage chamber of a bag assembly in accordance with this disclosure during a manufacturing process.

FIG. 19A is a view of a primary storage chamber 110 of a bag assembly 100 in accordance with this disclosure during a manufacturing process and mounted on a mold 1900. The mold may apply heat to the primary storage chamber 110 in order to melt the low-melt polymer yarn discussed above with respect to FIG. 1. Accordingly, after heating the primary storage chamber 110, the chamber should be thermoset and should therefore be stiffened in the shape shown.

Figure 19B:
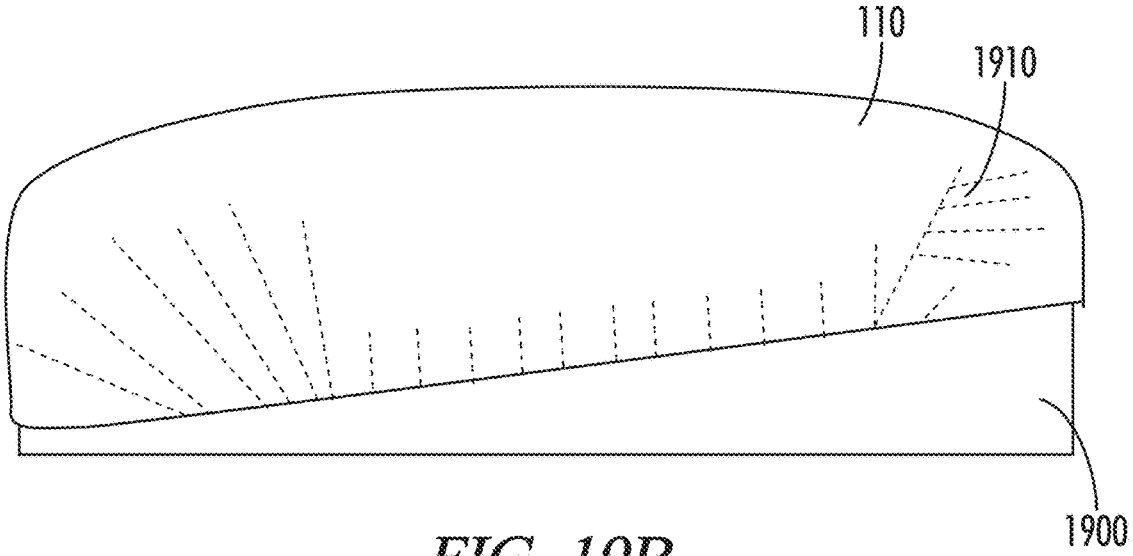
FIG. 19B shows an alternative embodiment of a primary storage chamber of a bag assembly in accordance with this disclosure during a manufacturing process.

FIG. 19B shows an alternative embodiment of a primary storage chamber 110 of a bag assembly 100 in accordance with this disclosure during a manufacturing process. As shown, the primary storage chamber 110 may be mounted on the mold 1900 at an angle in order to generate the particular shape sought. Goreing patterns 1910 are shown in the surface of the primary storage chamber 110 to show the shaping of the primary storage chamber 110.

Figure 19C:
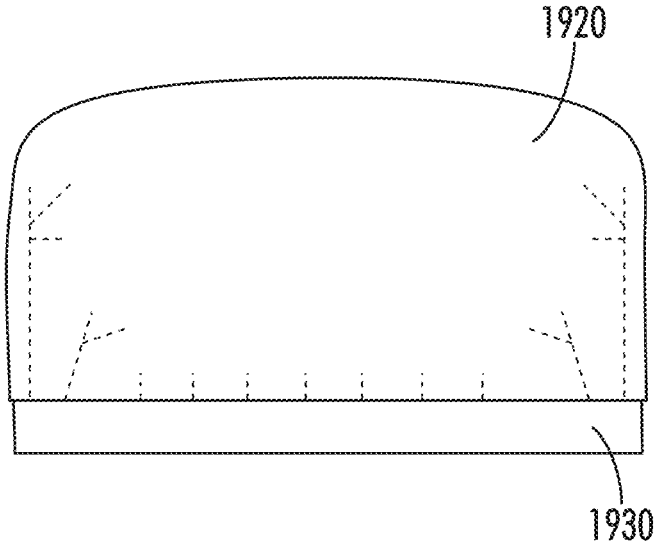
FIG. 19C shows an alternative embodiment of a primary storage chamber of a bag assembly in accordance with this disclosure during a manufacturing process.

FIG. 19C shows an alternative embodiment of a primary storage chamber of a bag assembly in accordance with this disclosure during a manufacturing process, with the primary storage chamber 1920 shown and the mold 1930 shown being sized and shaped for use in a duffle bag, a purse, or a messenger bag. Other sizes and shapes are possible as well, such as for a cross body bag or a fanny pack.

Figure 20:
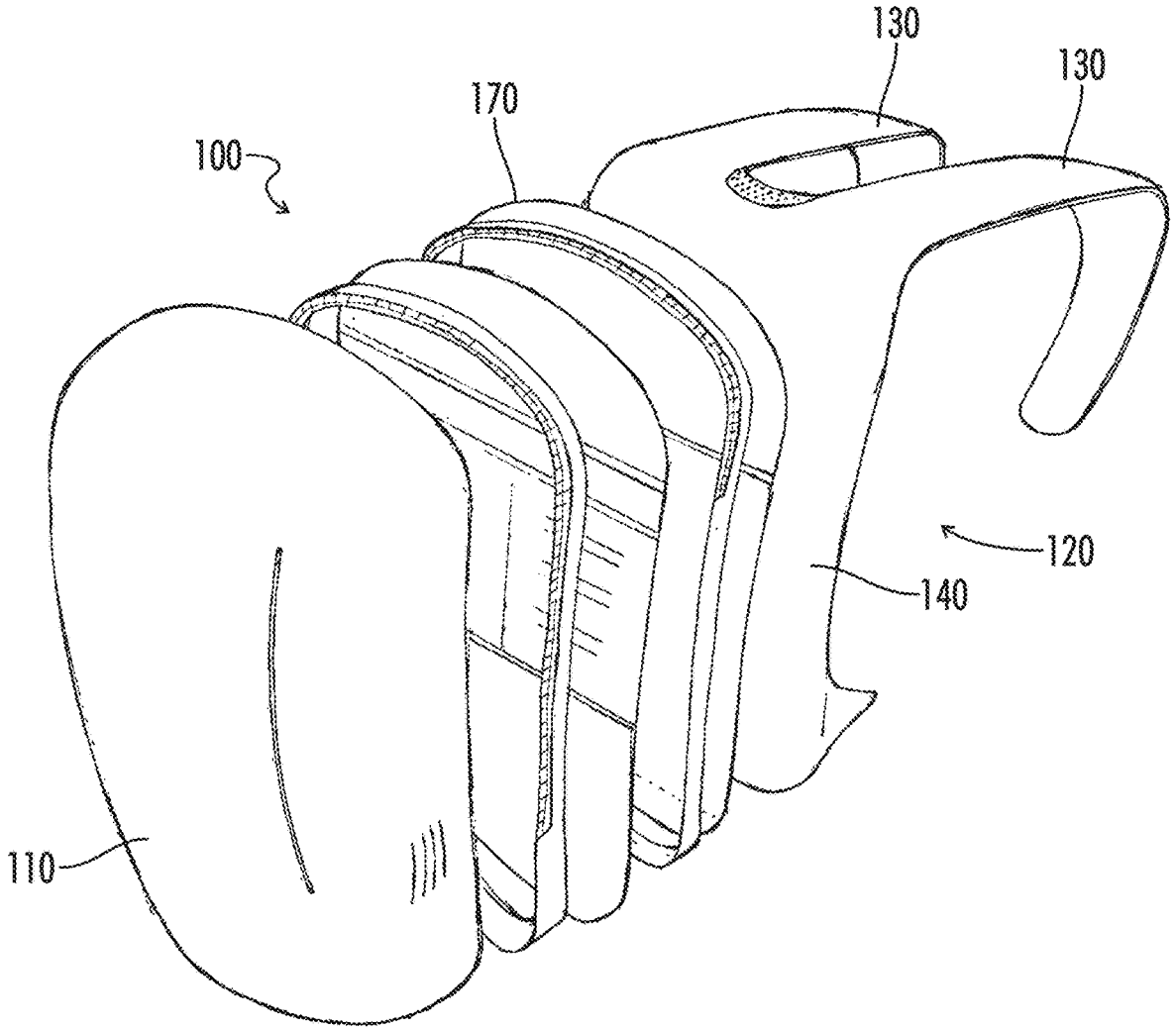
FIG. 20 is a perspective exploded view of an embodiment of a bag assembly in accordance with this disclosure.

FIG. 20 is a perspective exploded view of an embodiment of a bag assembly 100 in accordance with this disclosure. As shown, the bag assembly 100 typically includes a primary storage chamber 110 and a carrying structure 120. The carrying structure 120 typically has at least one strap 130 and a panel 140, and the straps may be seamlessly integrated into the panel. Additional storage compartments, including the secondary storage compartment 170 discussed above, may be incorporated as well.

FIG. 21A-D show an alternative embodiment of a bag assembly 2100 in accordance with this disclosure. As discussed above with respect to FIG. 1, the primary storage chamber 2110 of a bag assembly 2100 in accordance with this disclosure may be provided with segments 2120 that have increased flexibility relative to the rest of the primary storage chamber 2110. For example, where the primary storage chamber 2110 is made primarily of a double layered low-stretch stitch using nylon mixed with low-melt polymer yarn, functioning as a fusible yarn.

Accordingly, the primary storage chamber 2110 may be provided with segments 2120 where the fusible yarn, such as the low-melt polymer yarn, is not provided. In such an embodiment, while the primary storage chamber 2110 is stiffened, as discussed above, by melting the low-melt polymer yarn, the segments 2120 remain flexible due to the absence of fusible yarn.

Figure 21A:
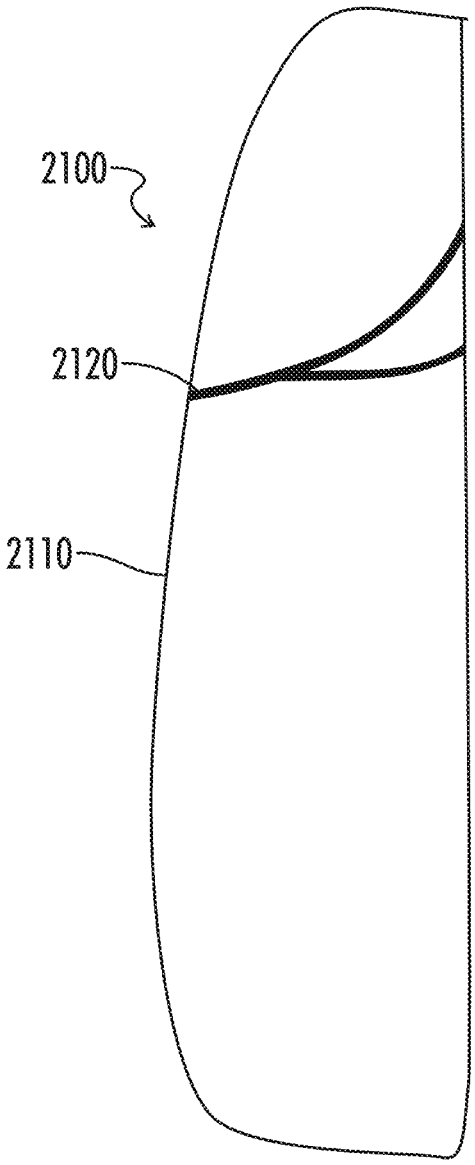
FIG. 21A-D show an alternative embodiment of a bag assembly in accordance with this disclosure.
Figure 21B:
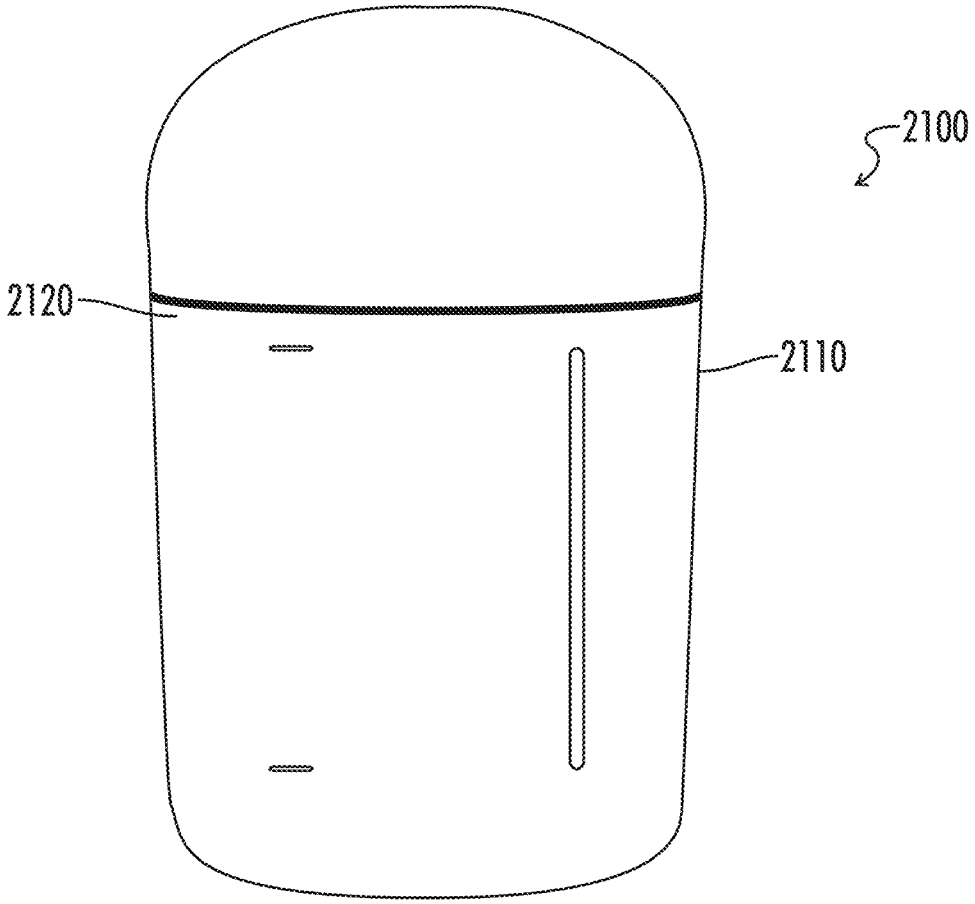
Figure 21C:
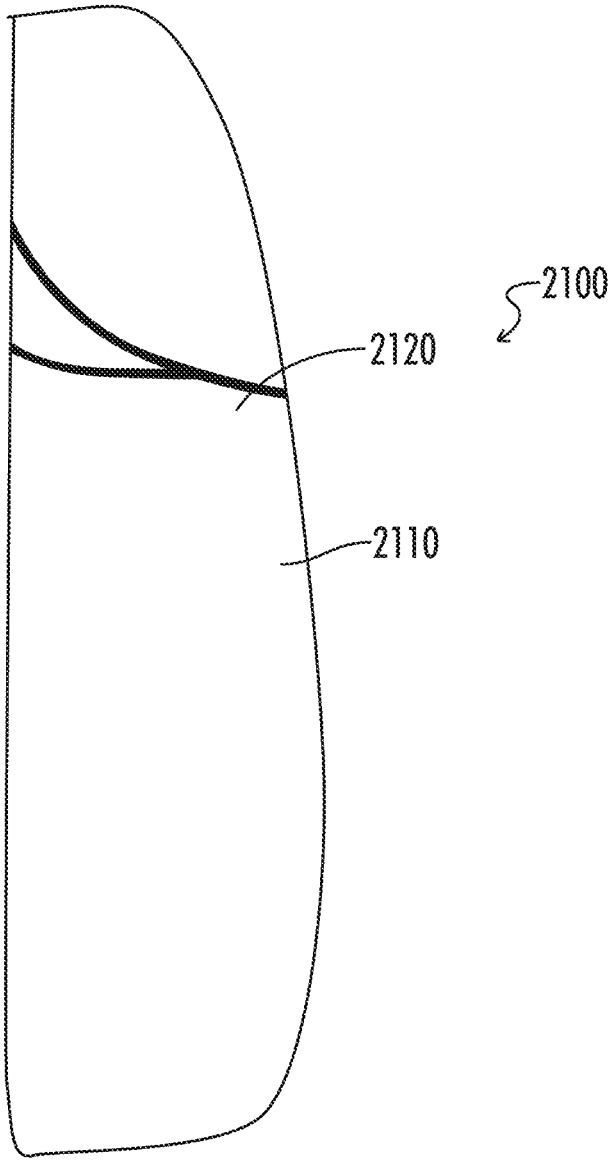
Figure 21D:
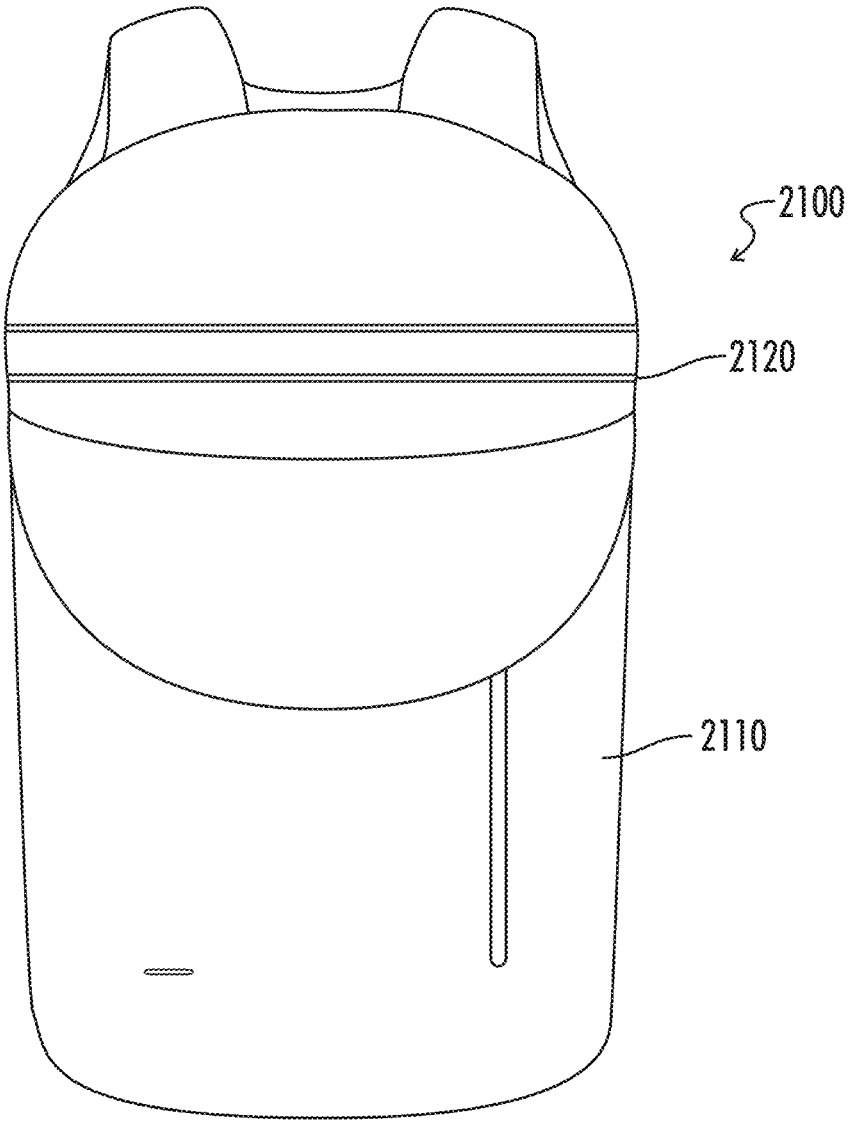

Accordingly, FIG. 21A shows a right side view of the primary storage chamber 2110 provided with flexible segments 2120 forming a folding guide for a user. FIG. 21B shows a back view of the primary storage chamber 2110, FIG. 21C shows a left side view, and FIG. 21D shows the primary storage chamber 2110 folded along the flexible segments 2120.

Figure 22:
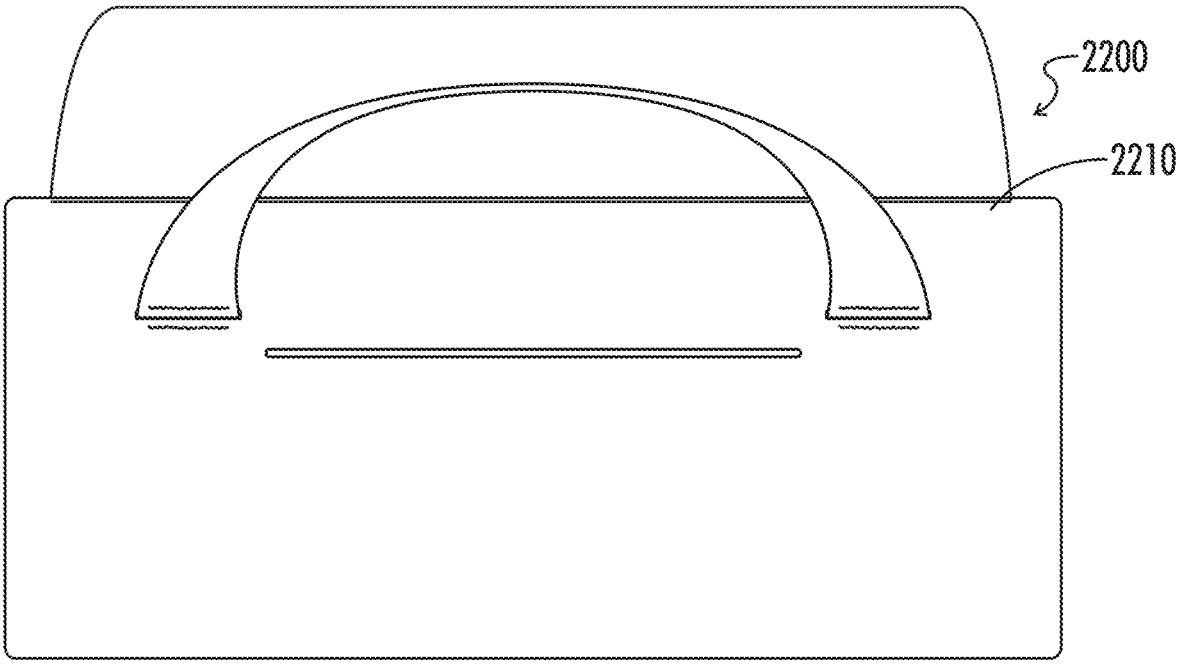
FIG. 22 shows an alternative embodiment of a bag assembly in accordance with this disclosure.

FIG. 22 shows an alternative embodiment of a bag assembly 2200 in accordance with this disclosure. As shown, a duffle bag or messenger bag embodiment may be provided with flexible segments 2210 in order to ease the opening of the otherwise stiffened bag.

Figure 23:
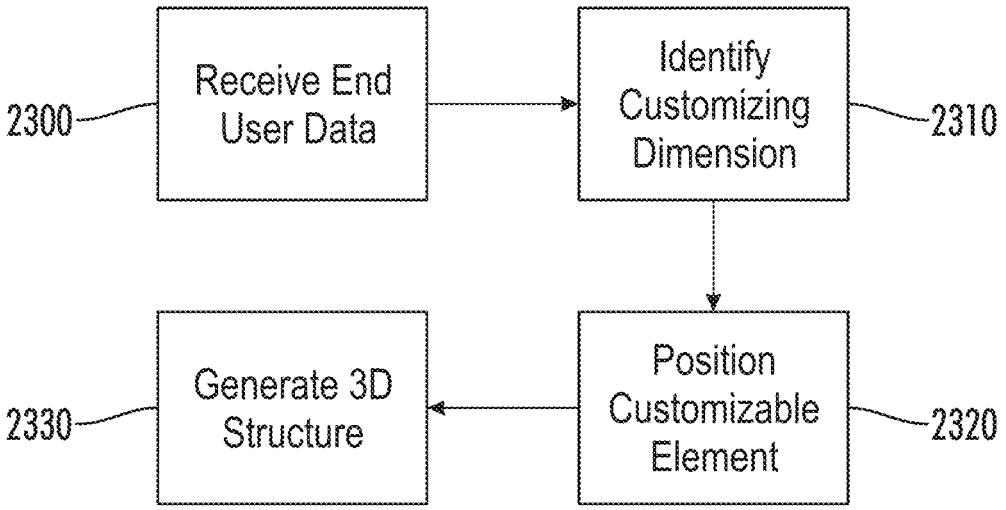
FIG. 23 is a flowchart illustrating a method for manufacturing a bag assembly in accordance with this disclosure.

FIG. 23 is a flowchart illustrating a method for manufacturing a bag assembly in accordance with this disclosure. As shown, the method provided comprises initially receiving end user data (2300) from an end user comprising physical characteristics of the end user of the bag assembly 100. The method then identifies, in the end user data, a customizing dimension (2310).

The customizing dimension may be, for example, a height of the end user, or a measurement of the end user's chest or torso, in terms of height or width. Similarly, the customizing dimension may be an arm length or the like.

The structure of the bag assembly 100 may then include a customizable element, and in a structure element, the method may then position (2320) the customizable element at a location defined based at least partially on the customizing dimension. Accordingly, the various knit components discussed above, such as the panel elements discussed with respect to FIGS. 5 and 9, may be relocated based on the customizing dimension.

After positioning the customizable element in the layout (at 2320), the method generates (at 2330) a 3D knit structure based on the structure layout, with the customizing element at the location defined in the layout.

The 3D knit structure is typically the carrying structure 120 discussed above for the bag assembly 100, and would typically include the panel 140 and the at least one shoulder strap 130 described above.

As discussed above, the panel 140 typically has a dense and stiffened spacer knit forming an outer boundary 530 and at least one shoulders trap 130 is fixed to the outer boundary. Further, at least a portion of the panel 540 within the outer boundary 530 and at least a portion of the at least one shoulder strap 600 comprise a spacer knit less dense and less stiff than the outer boundary. Further, the panel 140 may be provided with an inner boundary 550 that is stiffened and encompasses an inner segment 560 of the panel. The outer boundary 530 and the inner boundary 550 may define a channel 540, the channel comprising the spacer knit less dense and less stiff than the outer boundary. The inner boundary 550 may then be the customizable element, and it may be repositioned based on the customizing dimension identified (at 2310) I the end user data.

Further, the at least one shoulder strap 130 may comprise a support segment for resting on a user's shoulder. In some embodiments, the customizable element may be the location of the support segment in the shoulder strap.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention. Furthermore, the foregoing describes the invention in terms of embodiments foreseen by the inventor for which an enabling description was available, notwithstanding that insubstantial modifications of the invention, not presently foreseen, may nonetheless represent equivalents thereto.

What is claimed is:

1. A bag assembly comprising:

a primary storage chamber; and a carrying structure comprising a panel and at least one shoulder strap extending from the panel, wherein the strap and the panel are seamlessly integrated;

wherein the primary storage chamber is a first three dimensional (3D) knit structure comprising a first combination of materials, and wherein the carrying structure is a second 3D knit structure comprising a second material or combination of materials different than the first, wherein the first combination of materials comprises a primary yarn and a secondary yarn, and wherein the secondary yarn is a fusible yarn, wherein the primary storage chamber is first assembles by a 3D knitting process wherein the secondary yarn is selectively integrated, and wherein the primary storage chamber is thereby provided with integrated linear segments not including the secondary yarn, and the primary storage chamber is then heated over a mold to melt the fusible yarn and form a shell, and wherein the primary storage chamber is fixed to the panel of the carrying structure.

2. The bag assembly of claim 1, wherein the primary storage chamber is open on one side and has a rim, and wherein the rim of the primary storage chamber is fixed to a boundary of the panel of the carrying structure, such that the panel encloses an interior of the primary storage chamber.

3. The bag assembly of claim 1, wherein the primary storage chamber comprises a fusible yarn, and wherein the carrying structure does not.

4. The bag assembly of claim 1, wherein the primary yarn is nylon and the secondary yarn is a low melt polymer.

5. The bag assembly of claim 1, wherein the fusible yarn comprises a nylon sheath spun around a low melt core.

6. The bag assembly of claim 1, wherein the panel further comprises a dense and stiffened spacer knit forming an outer boundary around the panel, and wherein the at least one shoulder strap is seamlessly fixed to the outer boundary, and wherein at least a portion of the panel within the outer boundary and at least a portion of the at least one shoulder strap comprises a spacer knit less dense and less stiff than the outer boundary.

7. The bag assembly of claim 6, wherein the panel further comprises a dense and stiffened inner boundary, the inner boundary encompassing an inner segment of the panel, and wherein the outer boundary and the inner boundary define a channel therebetween, and wherein the channel comprises the spacer knit less dense and less stiff than the outer boundary, and wherein the inner segment of the panel comprises a porous knit structure.

8. The bag assembly of claim 7, wherein the inner boundary is located in the panel at a position based on a measured body size of an end user.

9. The bag assembly of claim 1, wherein the primary storage chamber is provided with surface curvature using a goreing technique.

10. The bag assembly of claim 1, wherein the linear segments define openings in a storage chamber, and wherein the fusible yarn is selectively integrated using I-Kat plating techniques.

11. The bag assembly of claim 1, wherein at least one of the linear segments define an opening to a secondary pocket internal to the primary storage chamber, the secondary pocket constructed by integral knitting or added by use of sewing techniques.

12. The bag assembly of claim 1, wherein the linear segments define a folding location or pattern, wherein, after the fusible yarn is fused, the primary storage chamber is foldable along the linear segments.

13. A bag assembly comprising:

a primary storage chamber; and a carrying structure comprising a panel and at least one shoulder strap extending from the panel, wherein the strap and the panel are seamlessly integrated;

wherein the primary storage chamber is a first three dimensional (3D) knit structure comprising a first 3D knit pattern, and wherein the carrying structure is a second 3D knit structure comprising a second 3D knit pattern different than the first, wherein the primary storage chamber comprises a combination of materials comprising a primary yarn and a secondary yarn, and wherein the secondary yarn is a fusible yarn, wherein the primary storage chamber is first assembles by a 3D knitting process wherein the secondary yarn is selectively integrated, and wherein the primary storage chamber is thereby provided with integrated linear segments not including the secondary yarn, and the primary storage chamber is then heated over a mold to melt the fusible yarn and form a shell, and wherein the primary storage chamber is fixed to the panel of the carrying structure.

14. The bag assembly of claim 13, wherein the panel further comprises a dense and stiffened spacer knit forming an outer boundary around the panel, and wherein the at least one shoulder strap is seamlessly fixed to the outer boundary, and wherein at least a portion of the panel within the outer boundary and at least a portion of the at least one shoulder strap comprises a spacer knit less dense and less stiff than the outer boundary.

15. The bag assembly of claim 14, wherein the panel further comprises a dense and stiffened inner boundary, the inner boundary encompassing an inner segment of the panel, and wherein the outer boundary and the inner boundary define a channel therebetween, and wherein the channel comprises the spacer knit less dense and less stiff than the outer boundary, and wherein the inner segment of the panel comprises a porous knit structure.

16. The bag assembly of claim 15, wherein the inner boundary is located in the panel at a position based on a measured body size of an end user.

17. The bag assembly of claim 13, wherein the at least one shoulder strap comprises two shoulder straps and a connecting element therebetween, wherein the connecting element comprises a 3D spacer knit less dense and more air permeable than the adjacent portions of the shoulder straps.

18. The bag assembly of claim 13, wherein the at least one shoulder strap comprises a low stretch knit segment and a high stretch knit segment, and gradual transition from the high stretch knit segment to the low stretch knit segment.

19. The bag assembly of claim 13, wherein the at least one shoulder strap comprises a support segment comprising a thicker padding knit than other segments of the shoulder strap.

* * * * *